US008118069B2

(12) United States Patent
Nakano et al.

(10) Patent No.: US 8,118,069 B2
(45) Date of Patent: Feb. 21, 2012

(54) METHOD FOR LOADING LIQUID, LIQUID CONTAINER AND HEAD CARTRIDGE

(75) Inventors: Yasushi Nakano, Inagi (JP); Kazuhiko Okito, Hiratsuka (JP); Sadayuki Sugama, Tsukuba (JP)

(73) Assignee: Canon Kabushiki Kaisha, Tokyo (JP)

( * ) Notice: Subject to any disclaimer, the term of this patent is extended or adjusted under 35 U.S.C. 154(b) by 608 days.

(21) Appl. No.: 12/303,117

(22) PCT Filed: Apr. 25, 2008

(86) PCT No.: PCT/JP2008/058450

§ 371 (c)(1),
(2), (4) Date: Dec. 2, 2008

(87) PCT Pub. No.: WO2008/139983

PCT Pub. Date: Nov. 20, 2008

(65) Prior Publication Data

US 2010/0101680 A1 Apr. 29, 2010

(30) Foreign Application Priority Data

Apr. 27, 2007 (JP) ..... 2007-119913

(51) Int. Cl.
*B65B 1/04* (2006.01)

(52) U.S. Cl. ..... 141/329; 141/1

(58) Field of Classification Search ..... 141/329, 141/1; 220/705, 707–709; 222/464.3, 464.5; 239/33

See application file for complete search history.

(56) References Cited

U.S. PATENT DOCUMENTS

| | | | | |
|---|---|---|---|---|
| 1,971,284 | A * | 8/1934 | Stockman | 222/90 |
| 5,509,140 | A | 4/1996 | Koitabashi et al. | 347/86 |
| 5,790,157 | A | 8/1998 | Higuma et al. | 347/85 |
| 6,053,604 | A | 4/2000 | Sato et al. | 347/85 |
| 6,116,722 | A | 9/2000 | Sato et al. | 347/85 |
| 6,196,413 | B1 * | 3/2001 | Tung | 220/709 |
| 6,247,803 | B1 | 6/2001 | Kanaya et al. | |
| 6,332,675 | B1 | 12/2001 | Koitabashi et al. | 347/86 |
| 6,692,115 | B2 | 2/2004 | Sanada et al. | 347/85 |
| 6,796,645 | B2 | 9/2004 | Hayashi et al. | 347/86 |

(Continued)

FOREIGN PATENT DOCUMENTS

BE 487188 2/1949

(Continued)

OTHER PUBLICATIONS

PCT International Preliminary Report on Patentability and Written Opinion of the International Searching Authority from Corresponding PCT Application No. PCT/JP2008/058450, mailed Nov. 5, 2009.

(Continued)

*Primary Examiner* — Davis Hwu
(74) *Attorney, Agent, or Firm* — Fitzpatrick, Cella, Harper & Scinto

(57) ABSTRACT

A liquid loading method, a liquid container and a head cartridge are provided, which allow the liquid container to be appropriately loaded with liquid such that a stirring member provided in the liquid container fully fulfills its function. For this end, an infusion needle is inserted from the outside of the ink cartridge into the ink storage chamber comprising a swinging member for stirring ink, so that the ink is loaded into the ink storage chamber through the infusion needle.

7 Claims, 22 Drawing Sheets

U.S. PATENT DOCUMENTS

| | | | | |
|---|---|---|---|---|
| 6,967,059 | B2 | 11/2005 | Sanada et al. | 428/405 |
| 2007/0052771 | A1 | 3/2007 | Inoue et al. | 347/86 |
| 2007/0263048 | A1 | 11/2007 | Okito et al. | 347/85 |

FOREIGN PATENT DOCUMENTS

| | | |
|---|---|---|
| CN | 1201938 | 5/2005 |
| EP | 1757453 | 2/2007 |
| EP | 1854633 | 11/2007 |
| GB | 2299972 | 10/1996 |
| JP | 2001-220457 | 8/2001 |
| JP | 2004-216761 | 8/2004 |
| JP | 2005-066520 | 3/2005 |

OTHER PUBLICATIONS

Chinese Office Action dated Apr. 22, 2010 issued during prosecution of corresponding Chinese Patent Application No. 200880000354.9.

* cited by examiner

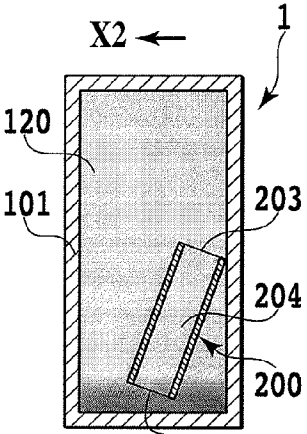
FIG.13A
FIG.13B
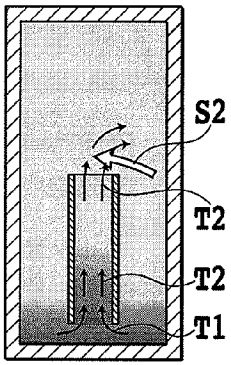
FIG.13C
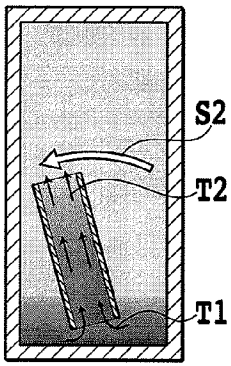
FIG.13D
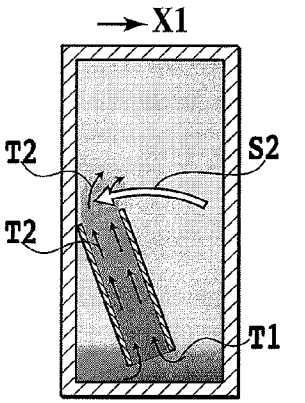
FIG.13E
FIG.13F
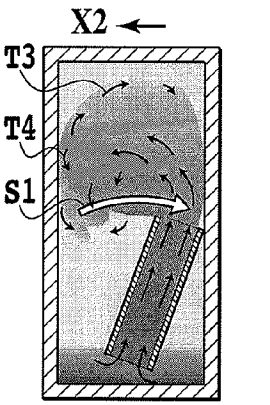
FIG.13G
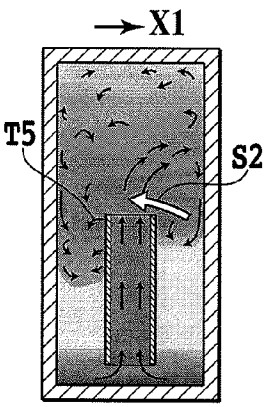
FIG.13H

METHOD FOR LOADING LIQUID, LIQUID CONTAINER AND HEAD CARTRIDGE

TECHNICAL FIELD

This invention relates to a liquid loading method for housing liquid such as ink in a liquid container, a liquid container for containing liquid such as ink, and a head cartridge comprising the liquid container.

BACKGROUND ART

A printing apparatus, for example, a so-called serial-type ink jet printing apparatus, comprises a carriage movable in the main scan direction which is mounted with a printing head capable of ejecting ink and an ink tank (liquid container) for containing the ink fed into the printing head. For printing an image, the printing apparatus repeats an operation of ejecting ink from an ejection port of the printing head toward a printing medium while moving the carriage in the main scan direction, and an operation of conveying the printing medium in a sub scan direction crossing to the main scan direction. The ink drops ejected from the printing head impact the printing medium to print the required image.

A mainstream ink used in such ink jet printing apparatus includes a dye as the colorant. In general, however, a dye ink somewhat lacks light fastness and gas fastness, and in some cases a print with the dye ink exhibits little image stability with durability in a special application such as for an outdoor notice.

In recent days, a printing apparatus using ink including a pigment as the colorant has been made available. A pigment ink has excellent light fastness and gas fastness, resulting in the print showing sufficient image stability. However, unlike the dye ink, the pigment ink needs to be handled with consideration for its dispersion properties.

The pigment molecules in the pigment ink do not dissolve in the ink solution as the dye molecules in the dye ink do, and are suspended and dispersed. If an ink tank containing the pigment ink is left still for a while, in some cases gravity makes the pigment particles gradually settle in the ink tank, giving rise to a concentration gradient of the pigment particles in the height direction of the ink tank. Specifically, a layer of a high colorant concentration is located in the bottom portion of the ink tank and a layer of a low colorant concentration is located in the upper portion thereof. When the ink is fed from the ink tank to the printing head in this situation to start and continue an operation of printing an image, a difference in concentration may possibly occur on the image between an initial stage and a later stage of the printing operation.

To give a concrete illustration, an ink jet printing apparatus structured to supply ink from the bottom of an ink tank to a printing head is considered. When the printing apparatus is installed with the aforementioned ink tank having a concentration gradient of the pigment particles and then starts the printing operation, the ink contained in the lower portion of the ink tank with a high colorant concentration is supplied in at an early stage in the printing, thus printing an image with a density higher than necessary. Thereafter, as the printing operation continues to be performed, the density of the printed image is gradually reduced along with the consumption of ink in the ink tank. Then, when the amount of the ink in the ink tank becomes low, the ink remaining in the ink tank has a lower colorant concentration than the original one. For this reason, even when the image is printed based on the same image data as that at the beginning of the printing operation, the printing density becomes lighter. Specifically, since a large diameter or a high specific gravity of the pigment particle makes the pigment particle significantly apt to settle, even when a non-use state of the ink tank lasts just for a few days, a concentration gradient as much as to affect the image may possibly occur.

The colorant concentration of the ink ejected from the printing head changes with the use of the ink tank as described above. This not only causes a difference in density of the printed image between the initial service stage and the later service stage of the ink tank. For example, in a color ink jet printing system using a plurality of color inks to express hues in predetermined color balance, the color balance may be lost. This event is to be recognized as a more remarkable problem of the difference between the image densities.

In order to maintain the colorant concentration of the ink drops ejected from the printing head within a constant concentration range regardless of the amount of ink remaining in the ink tank, the pigment molecules are desired to be uniformly dispersed in the ink tank, at least during the printing operation.

One proposal made for achieving such uniform dispersion of the pigment molecules is a structure for providing a stirring member in the ink tank for stirring the pigment molecules.

Japanese Patent Laid-Open No. 2005-066520 discloses an ink pack provided with a manually operable stirring member. The stirring member is shaped so as to be inserted into the ink pack from outside. An outwardly projecting part of the stirring member serves as a manipulating portion for operating a stirring section of the stirring member extending into the ink pack. Specifically, a user swings the stirring portion at regular intervals or as needed in order to stir the ink in the ink pack for dispersion of the pigment molecules.

Also, Japanese Patent Laid-Open No. 2005-066520 discloses an ink cartridge provided with a swinging member for stirring the ink in the tank through the use of an inertial force arising from the movement of the carriage during the printing operation, of which an example described is a stirring member formed integrally with the ink cartridge case. In this example, the stirring member extends in such a manner to hang down from the ceiling of the ink cartridge case toward the bottom, and has a cylindrically shaped weight formed at the lower end. An inertial force arising from an accelerating, stopping or reversal operation of the carriage makes the stirring member swing around the fulcrum, which is the pivoted end joined to the ceiling, in the moving direction of the carriage to stir the ink in the ink cartridge.

In addition, Japanese Patent Laid-Open No. 2005-066520 discloses another example of a stirring member which is not secured to the ink cartridge case and is movable freely over the bottom inner face of the ink cartridge. This stirring member is operative to move over the bottom inner face of the ink cartridge to stir the ink by the inertial force arising from the accelerating, stopping or reversal operation of the carriage.

Japanese Patent Laid-Open No. 2004-216761 discloses a stirring mechanism which comprises a shaft-shaped weight swinging in the right and left directions of the swinging central axis by the inertial force arising from the movement of the carriage, and a plurality of fins singing in the right and left directions in combination with the shaft-shaped weight. In this structure, since the plurality of the fins are arranged in parallel in the height direction of the ink cartridge, the ink is stirred equally from the upper portion to the lower portion of the ink cartridge.

However, neither of the foregoing Japanese Patent Laid-Open Nos. 2005-066520 and 2004-216761 have particular reference to a method for loading ink (liquid) into an ink cartridge (liquid container) provided with a stirring member.

DISCLOSURE OF THE INVENTION

The present invention provides a liquid loading method, a liquid container and a head cartridge which allow the liquid container to be appropriately loaded with liquid such that a stirring member provided in the liquid container fully fulfills its function.

According to an aspect of the present invention, a loading method for loading liquid into a liquid container comprising a liquid reservoir capable of housing liquid, and a stirring member provided in the liquid reservoir and having a hollow portion formed therein for guiding the liquid in the liquid reservoir, comprises the steps of: inserting a liquid loading member for loading liquid into the liquid reservoir, from the outside of the liquid container into the liquid reservoir; and loading the liquid into the liquid reservoir through the liquid loading member to reach or exceed a level for submerging at least a part of the hollow portion of the stirring member in the liquid.

According to another aspect of the present invention, a liquid container comprises: a liquid reservoir capable of housing liquid; a stirring member provided in the liquid reservoir and having a hollow portion formed therein for guiding the liquid in the liquid reservoir; and a portion allowing a liquid loading member for loading liquid into the liquid reservoir to be inserted from the outside of the liquid container into the liquid reservoir, wherein the portion is located in a site allowing the liquid to be loaded into the liquid reservoir through the liquid loading member to reach or exceed a level for submerging at least a part of the hollow portion of the stirring member in the liquid.

According to yet another aspect of the present invention, a head cartridge comprises: the liquid container in the case of another aspect; and a liquid discharge head capable of discharging the liquid introduced from the liquid delivery port of the liquid container.

According to still another aspect of the present invention, a liquid loading method for loading liquid into a liquid container comprising a liquid reservoir capable of housing liquid, and a stirring member having a hollow portion formed therein for guiding the liquid in the liquid reservoir, comprises the step of: inserting a liquid loading member for loading liquid into the liquid reservoir, from the outside of the liquid container into the stirring member provided in the liquid container; and loading the liquid into the liquid reservoir through the liquid loading member.

According to the present invention, the loading of liquid into the liquid container through the liquid-loading member inserted into the liquid container from outside makes it possible to load liquid without its bubbling or to load liquid in such a manner as to remove the bubbles produced. As a result, it is possible to reduce the amount of bubbles occurring and/or remaining in the liquid container and a hollow portion of the stirring member to minimize the adverse effects of bubbles which may possibly interrupt the flow of the liquid.

For example, the liquid-stirring function of the stirring member can be fully fulfilled by reducing the amount of bubbles occurring and/or remaining in the liquid container, and in particular, in the hollow portion of the stirring member. Also, the full loading of the liquid is made possible without its being inhibited by the bubbles in the liquid container, thus making it possible to reliably load ink to the extent that the stirring member can adequately fulfill its stirring function. In other words, the liquid can be fully loaded in an amount to reach or exceed a level for submerging at least a part of the hollow portion of the stirring member in the liquid when the liquid container is in the operating position (positioned to orient the liquid delivery port downward in the gravity direction).

Further features of the present invention will become apparent from the following description of exemplary embodiments (with reference to the attached drawings).

BRIEF DESCRIPTION OF THE DRAWINGS

FIG. 13A to FIG. 13H are sectional views each showing an ink cartridge for illustrating the operation of the swinging member in FIG. 6;

BEST MODE FOR CARRYING OUT THE INVENTION

Figure 1:
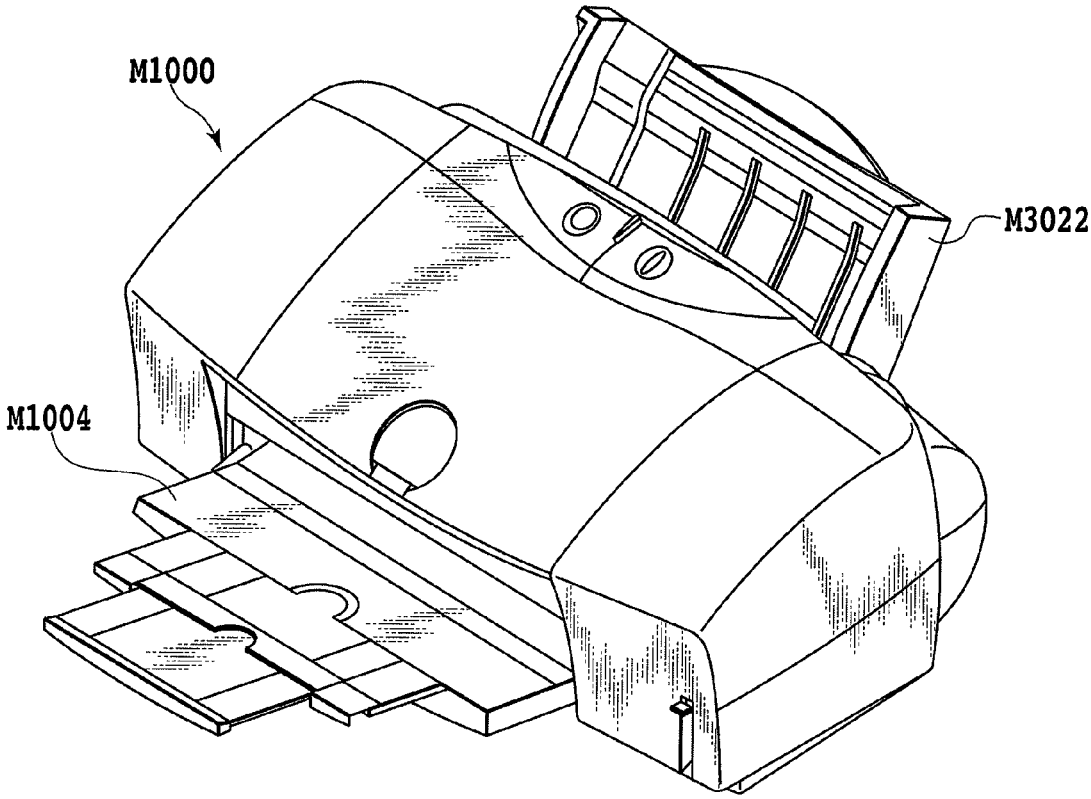
FIG. 1 is an outside perspective view of a printing apparatus in a first embodiment of the present invention.

This invention has been made with attention focused on the fact that, when a stirring member provided for stirring liquid in a liquid container has a hollow portion formed therein for guiding the liquid, bubbles existing in the liquid container, in particular in the hollow portion of the stirring member affect the function of stirring the ink. That is, if bubbles exist in the liquid container, in particular in the hollow portion of the stirring member, the flow of the ink is inhibited, which may possibly make the performance of the function of stirring the ink insufficient. The present invention achieves the loading of ink which can reduce occurrence and remaining of bubbles for the purpose of allowing a stirring member to fully perform its stirring function.

Embodiments of the present invention will be described below with reference to the drawings.

First Embodiment

A liquid container in this embodiment is an example of the case when it is applied as a cartridge-type ink tank (ink cartridge) which is mountable on a so-called serial scan type ink jet printing apparatus.

(Operating Position of Ink Tank (Liquid Container))

Inkjet printing apparatuses have been expanded to business printers, consumer printers and the like. In general, these printing apparatuses are of a stationary type and are placed in a specified position at the time of printing. One of the reasons why a position of the printing apparatus when being operated is specified is the stabilization of the operational environment of the printing apparatus in order to achieve optimum printing. The operating position of the printing apparatus is specified, for example, with regard to the supplying condition of the ink from the ink tank to the printing head in the printing apparatus, the ejecting condition of the ink drops from the printing head, the flight condition of the ink, and the like. Accordingly, in general, the operating position of the ink jet printing apparatus is uniquely specified.

An ink tank (including an inkjet cartridge united with a printing head) which is used in such an ink jet printing apparatus of which the operating position is specified as described above is mounted in a specified position on an ink-tank mounting section of the ink jet printing apparatus. For example, in a serial scan ink jet printing apparatus, a mounted position (the position under operation condition) of the ink tank, which is of the type of being mounted on the carriage together with the printing head, is uniquely specified as a position of the ink tank at the time of being mounted on the carriage. Also, when the ink tank is of a stationary type that is placed in a mounting section located away from the printing head and is connected to the printing head via a tube or the like, a mounted position (the position under operation condition) of the ink tank is uniquely specified as a position of the ink tank at the time of being installed on the mounting portion.

In this manner, the mounted position (the position under operation condition) of an ink tank used in a typical ink jet printing apparatus is substantially uniquely specified.

For example, in a dominating ink jet printing apparatus comprising an ink tank mounted on a carriage, the ink tank is mounted with an ink supply port of the ink tank facing downward in the gravity direction, so that the ink is supplied from the ink supply port in the gravity direction. The mounted position of the ink tank in such an ink jet printing apparatus is defined as a position in which the ink supply port faces downward in the gravity direction. The mounted position is specified in a similar manner in another ink tank differing in an internal structure. An example of the ink tank differing in the internal structure includes a type of ink tank housing an ink absorber nearly with its entirety, and a type of ink tank having two divided spaces in which one space housing an ink absorber and the other space directly housing the ink. Also, in another type of ink tank, ink is housed directly in the entire interior of the ink tank.

In addition, there is a type of ink tank having an ink supply port placed on its side face. The mounted position of the ink tank of this type on the carriage is a position in which at least the ink can be supplied in the horizontal direction from the ink supply port.

Further, in a stationary type ink tank placed in a mounting section located away from the printing head, the ink tank is mounted in a position with the ink supply port facing downward in the gravity direction so that at least the ink can be supplied from the ink supply port in the gravity direction. In another stationary type ink tank, the ink tank is mounted in a position with the ink supply port facing in a direction at right angles to the gravity direction so that at least the ink can be supplied from the ink supply port in the horizontal direction.

In any type of ink tank, since, for example, the method for mounting the ink tank to a printing apparatus or the like is explained on the packaging, in an enclosed instruction manual or the like, the operating position of the ink tank can be specified.

Some of the ink jet printing apparatuses such as those called mobile printers utilize the convenience owing to being mobile and are in variously differing positions such as in a horizontal position or in a vertical position, for example. In the case of such a printing apparatus, the operating position of the ink tank also varies in accordance with the position of the printing apparatus. In the case of such a printing apparatus, the position specified under the main operation condition is defined as a basic operating position, and the position of the ink tank used when the printing apparatus is used in the basic operation position can be considered as the operating position of the ink tank. The ink tank may form part of an ink jet cartridge united with a printing head.

(Structure of Ink Jet Printing Apparatus)

FIG. 1 is an outside perspective view of a serial scan type ink jet printing apparatus in the example. The printing apparatus essentially comprises a printing apparatus body M1000 for making printing on a printing medium, a sheet feeder M3022 for feeding a printing medium into the printing apparatus, and an output tray 4 receiving the printed printing medium.

Figure 2:
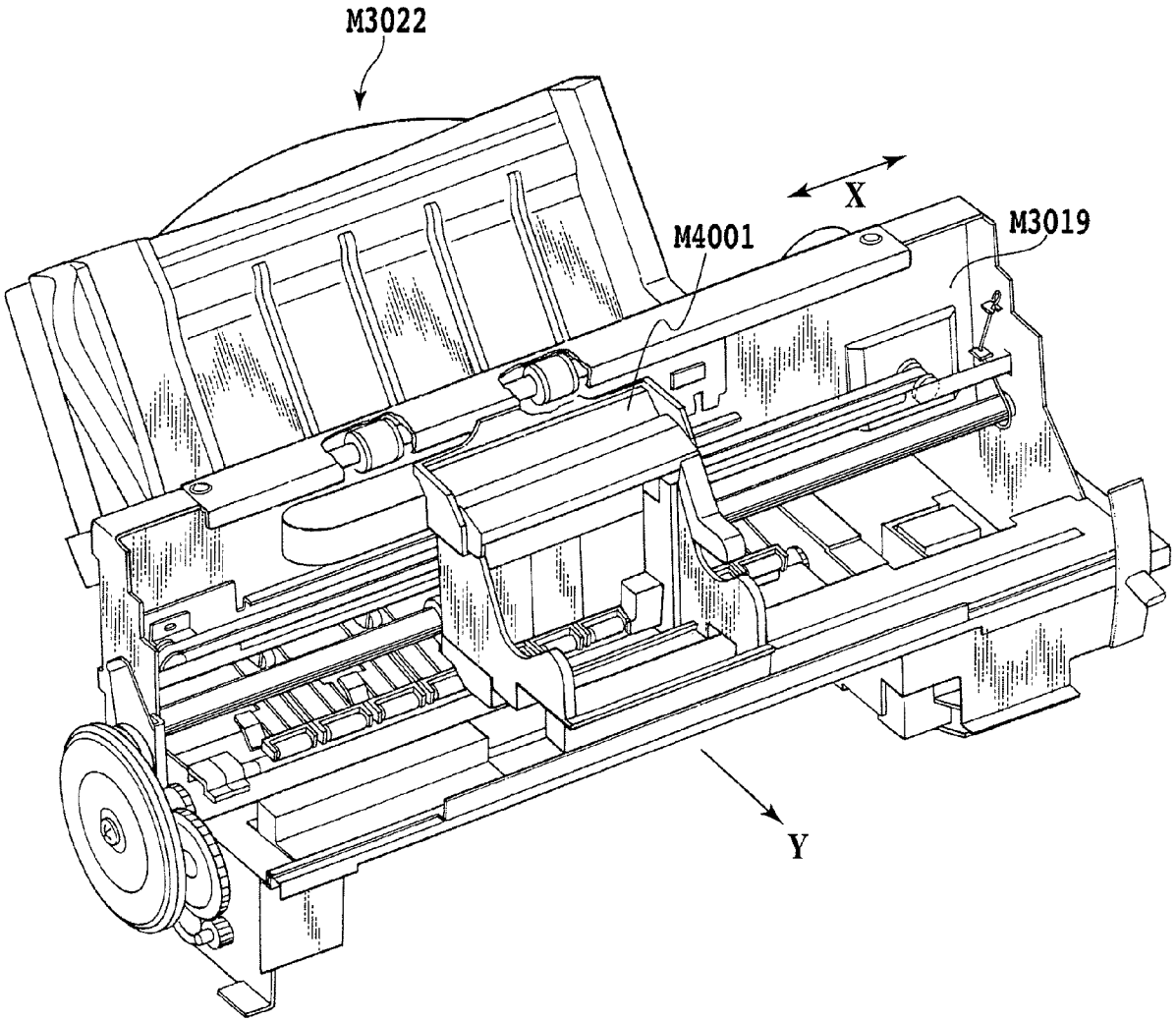
FIG. 2 is a perspective view illustrating an internal mechanism of the printing apparatus in FIG. 1.

FIG. 2 is a perspective view illustrating the internal mechanism of the printing apparatus body M1000. The main internal mechanism of the printing apparatus body M1000 is provided on and protected by a chassis M3019. M4001 denotes a carriage which is movable to and from in a main scan direction indicated by the arrows X when mounted with a printing head cartridge (not shown). When a printing command is entered, one of the printing media loaded in the sheet feeder M3022 is fed and conveyed to a site in which the printing head cartridge on the carriage M4001 can print an image. Then, the printing apparatus repeats the print scanning operation of ejecting ink from the printing head of the printing head cartridge on the basis of the image data while the carriage M4001 moves in the main scan direction, and the operation of using a convey unit to convey the printing medium in a sub scan direction indicated by the arrow Y. Thus, the image is sequentially formed on the printing medium.

Figure 3:
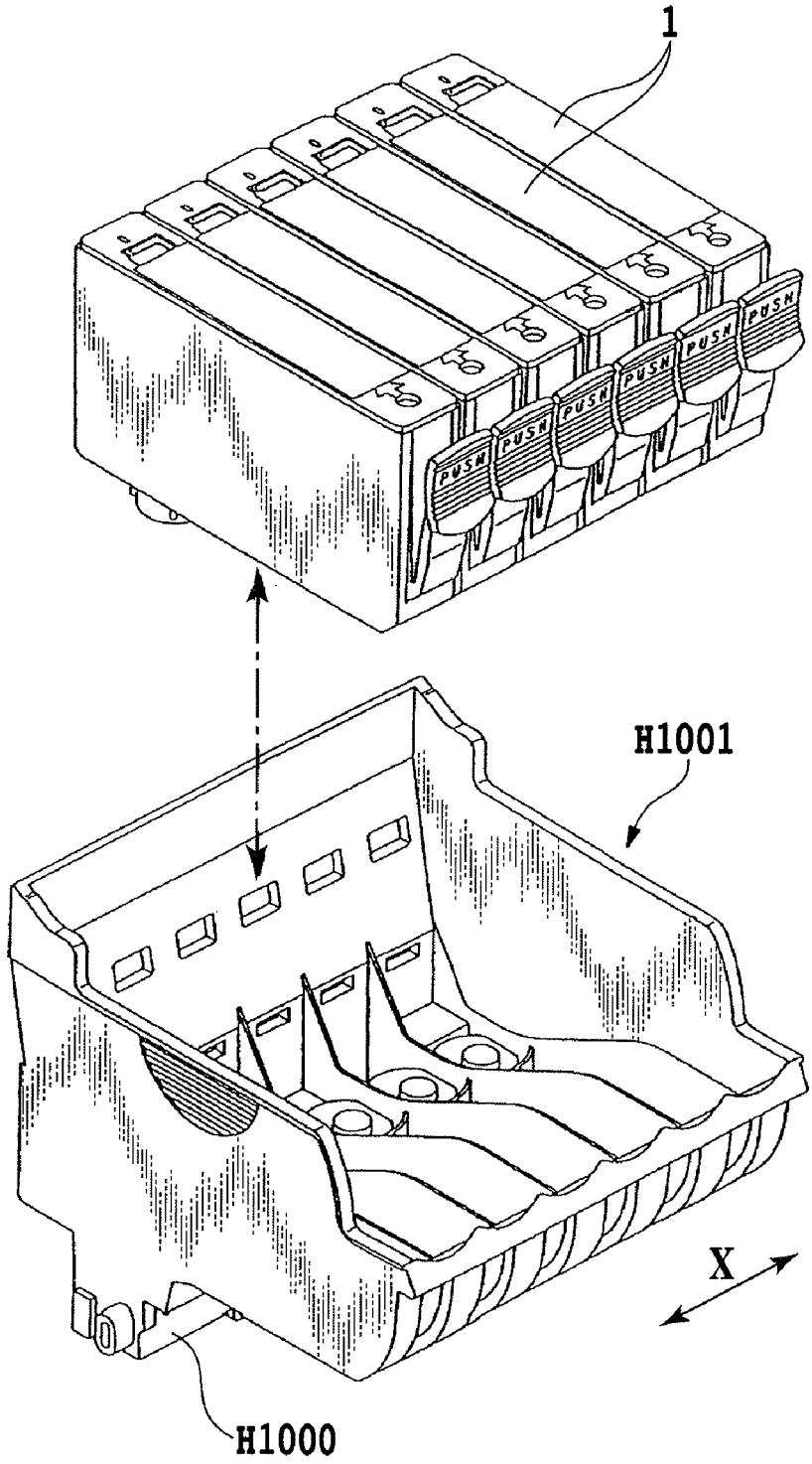
FIG. 3 is a perspective view of a printing head cartridge and an ink cartridge which are mountable on a carriage in FIG. 2.

FIG. 3 is a perspective view of a printing head cartridge H1001 and ink cartridges 1 (liquid container) in the example. The ink cartridges 1 are cartridge-type ink tanks. The printing head cartridge H1001 comprises a printing head H1000 provided on one side which ejects ink drops from an ejection port, and the ink cartridges 1 are detachably mounted on the other side of the printing head cartridge H1001 for supplying ink to the printing head (liquid ejecting head) H1000. The printing head cartridge H1000 of the example is designed to allow the six color ink cartridges 1 to be independently mounted. The ink cartridges 1 may integrally comprise a printing head H1000 to form a head cartridge.

The printing head H1000 comprises an array of a plurality of fine printing elements each of which comprises a mechanism for ejecting ink. For example, in the structure including an electrothermal transducing element having a heating resistor (heater), in response to an ink-eject signal a voltage pulse is impressed to each electrothermal transducing element. As a result, the ink in the vicinity of the heating resistor is sharply heated to produce film boiling, the influence of which then causes the ink drops to be ejected from the ejection port.

(Structure of Entire Ink Cartridge)

Figure 4:
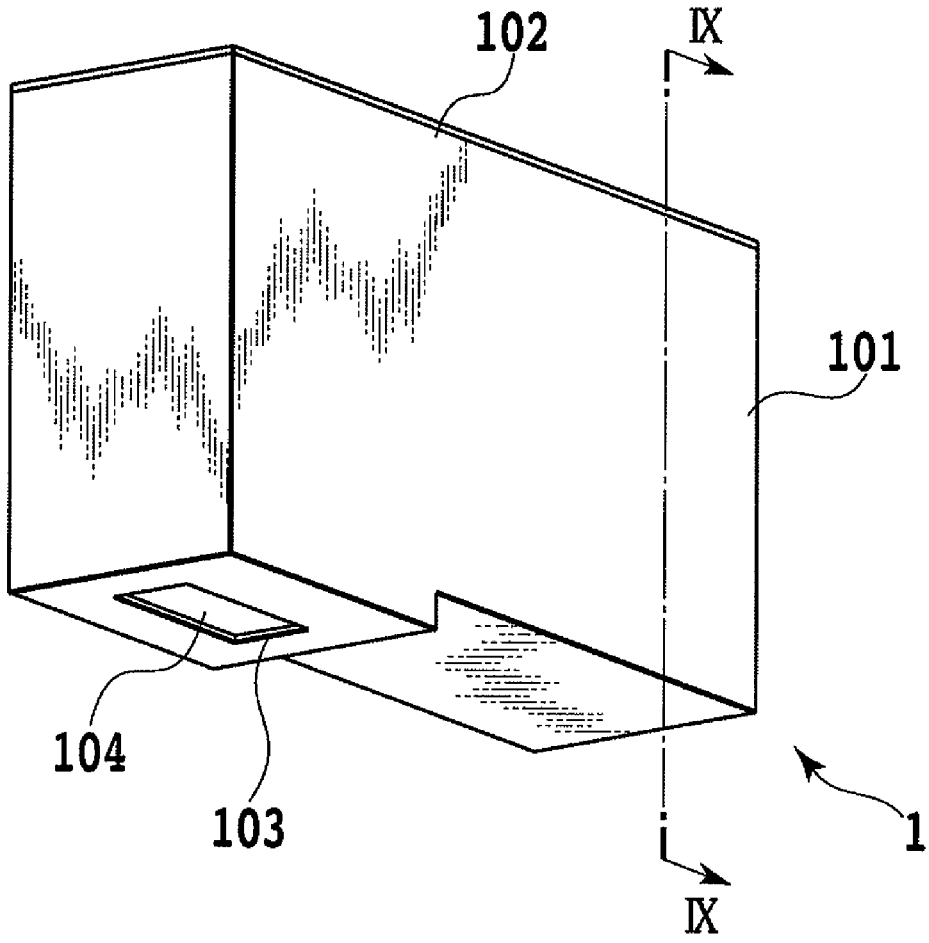
FIG. 4 is a perspective view of the ink cartridge in FIG. 3.

FIG. 4 is an outside perspective view of the ink cartridge 1. The ink cartridge 1 of the example is a container having an ink storage chamber formed therein, which comprises a container body 101, a lid member 102 and a negative-pressure generating member. The ink cartridge 1 has an ink supply port 103 in the bottom for supplying ink to the printing head H1000.

Figure 5:
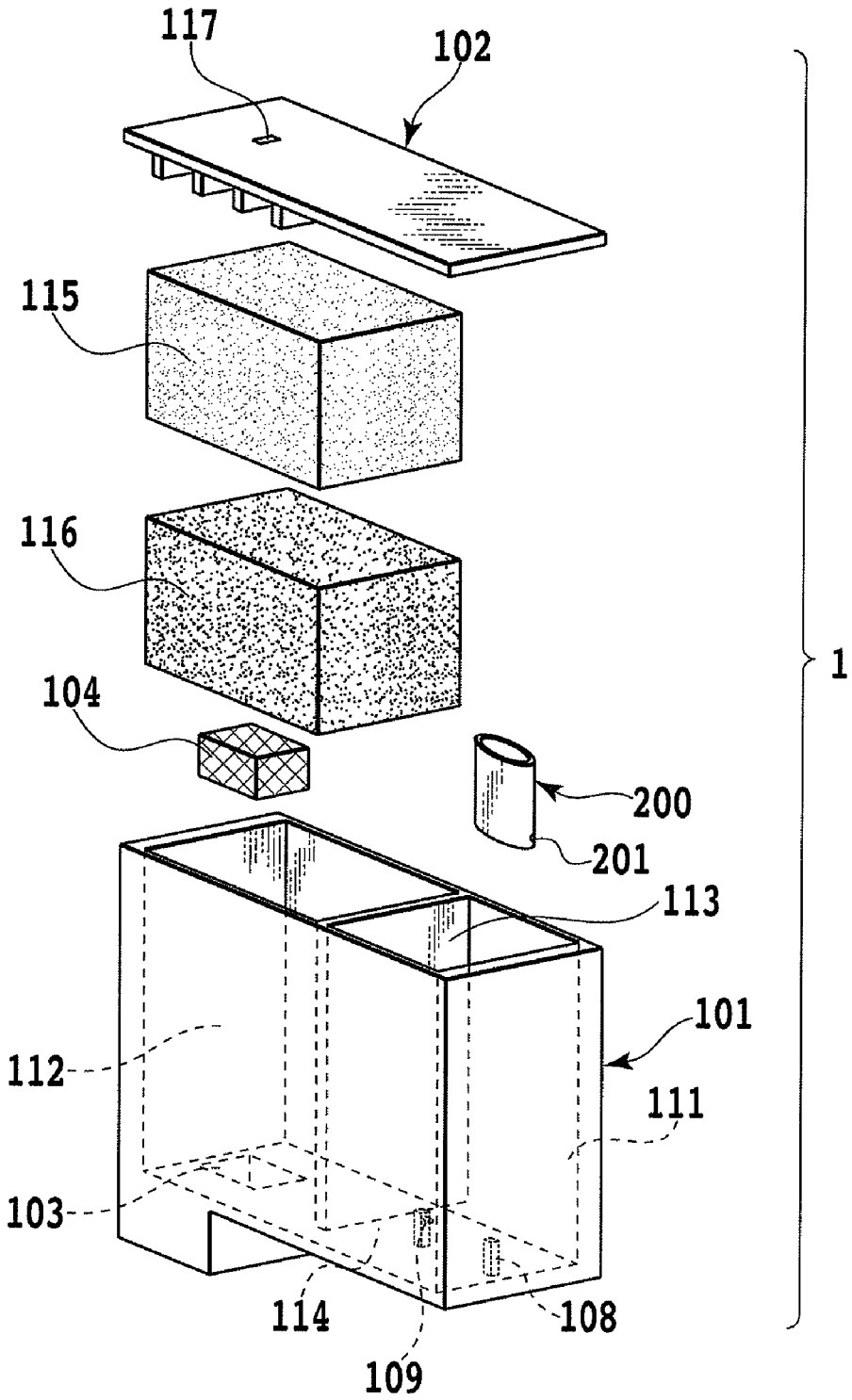
FIG. 5 is an exploded perspective view of the ink cartridge in FIG. 3.
Figure 6:
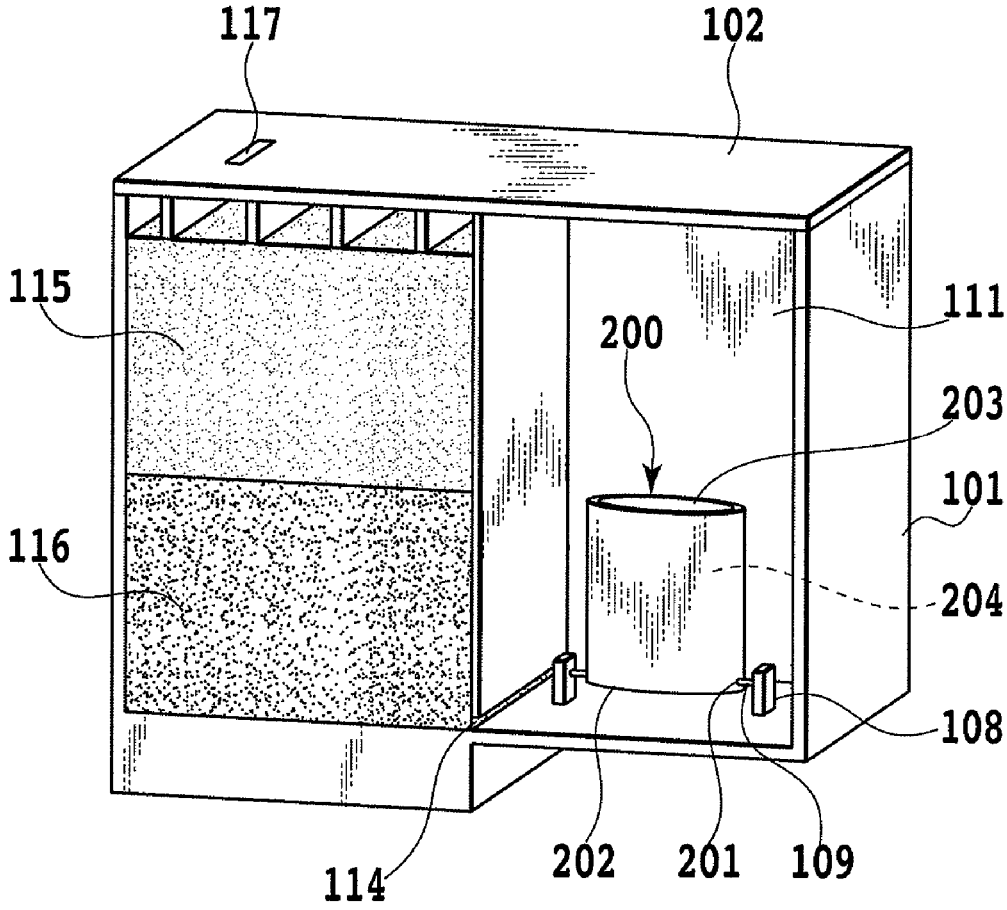
FIG. 6 is a perspective view of the principal part for illustrating the mounting of a swinging member in FIG. 5.

FIG. 5 is an exploded perspective view of the ink cartridge 1. The container body 101 of the ink cartridge 1 is formed of, for example, polypropylene, and a swinging member 200 is accommodated in the container body 101 for stirring the ink as shown in FIG. 6. An aperture in the top of the container body 101 is covered with the lid member 102. The inside of the ink cartridge is divided into two spaces partitioned by a partition 113 and communicating with each other through a linking portion 114 which is formed beneath the partition 113. One of the spaces is substantially sealed except for the linking portion 114 beneath the partition 113, to form an ink storage chamber 111 capable of directly containing the ink. The other space houses a first and a second negative-pressure generating member 115, 116 for holding the ink to form a negative-pressure generating chamber 112 for applying a negative pressure to the ink. The negative-pressure generating chamber 112 has an atmospheric communication port 117 and the supply port 103 formed therein. The atmospheric communication port 117 is formed in the lid member 102 to introduce air into the ink cartridge 1 according to consumption of the ink. The supply port 103 is formed in the container body 101 and is capable of guiding the ink to the outside in order to supply the ink contained in the ink cartridge 1 to the printing head. The supply port 103 is provided with a meniscus producing member 104 for holding the ink. The meniscus of the ink occurring in the meniscus producing member 104 prevents bubbles from entering the ink cartridge 1 from the outside.

The first and the second negative-pressure generating member 115, 116 each are made of, for example, a polypropylene textile material and generates a capillary force. These negative-pressure generating members 115 and 116 are pressed into contact with each other. When the capillary force of the first negative-pressure generating member 115 is defined as P1, that of the second negative-pressure generating member 116 as P2, and that of the meniscus producing member 104 as P3, these capillary forces have the relationship of P1<P2<P3.

In the ink cartridge 1 thus structured, when the ink in the negative-pressure generating chamber 112 is consumed by the printing head, air is introduced from the atmospheric communication port 117 into the negative-pressure generating chamber 112, then enters the ink storage chamber 111 through the linking portion 114 beneath the partition 113. With the entry of air into the ink storage chamber 111, the ink in the ink storage chamber 111 flows into the negative-pressure generating chamber 112 through the linking portion 114 beneath the partition 113, and then is absorbed into the negative-pressure generating members 115 and 116. Thus, a gas-liquid exchange is performed by the air and the ink via the linking portion 114.

(Structure of Stirring Mechanism)

Figure 7:
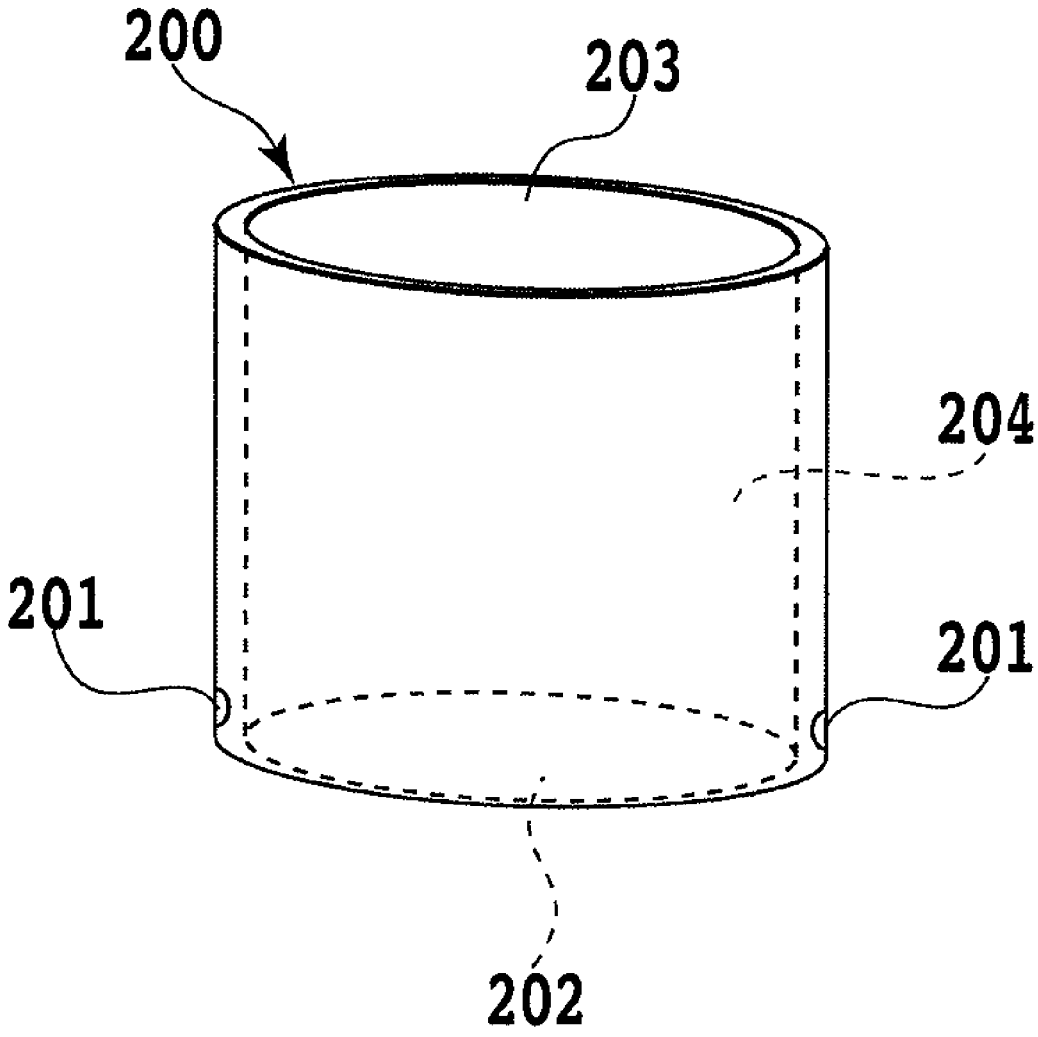
FIG. 7 is an enlarged perspective view of the swinging member in FIG. 5.

FIG. 6 is a perspective view for illustrating the mounting of the swinging member 200, and FIG. 7 is an enlarged perspective view of the swinging member 200.

The swinging member 200 has a lower aperture 202 in a lower portion of the ink cartridge 1 in the gravity direction, and an upper aperture 203 formed in an upper portion of the ink cartridge 1. An elliptical cross-section hollow portion 204 is formed between the apertures 202 and 203. Accordingly, the swinging member 200 of the example is formed three-dimensionally in an elliptical cylindrical shape. Two recessed supports 201 are located on the long axis of the elliptical close to the lower aperture 202.

The swinging member 200 in the example is formed of a stainless material and the inner face of the hollow portion 204 is subjected to hydrophilic treatment through, for example, sandblasting or the like in order to prevent bubbles from accumulating on the inner face. However, the material used to form the swinging member 200 is not limited to the stainless material but needs to have a larger specific gravity than that of the ink accommodated in the ink cartridge 1.

As shown in FIG. 6, securing members 108 having projections 109 are provided on the inner wall of the ink storage chamber 111. The projections 109 are fitted into the recessed supports 201 of the swinging member, whereby the supports 201 serve as fulcrums when the swinging member 200 swings. The swinging member 200 can swing about the supports 201 as the fulcrums. Since a portion close to the lower aperture 202 of the swinging member 200 in the example is swingably supported, the amount of displacement of the upper aperture 203 becomes larger than that of the lower aperture 202 when the swinging member 200 swings.

(Composition of Loaded Ink)

The ink used in the example is, for example, an ink including a pigment component (pigment ink). The pigment in the pigment ink may be, for example, a resin-dispersant-type pigment using a dispersant or an activator (resin dispersion pigment), or an activator-dispersion-type pigment. The pigment may be a microcapsule pigment allowed to disperse without a dispersant or the like by means of an increase in the dispersion properties of a water-insoluble colorant itself, or a self-dispersion-type pigment in which a hydrophilic group is introduced onto the surface of the pigment particles (self-dispersion pigment). Also, a pigment modified by chemically bonding an organic group including polymer molecules to the surfaces of the pigment particles (polymer-bonded self-dispersion pigment) may be used. It goes without saying that pigments differing in dispersion method may be used in combination. The pigments usable in the present invention are not specially limited.

Table 1 below shows two exemplary kinds (pigment inks 1, 2) of compositions of pigment ink used in the example. However, the present invention is not limited to these compositions.

The pigment ink used in the example has a mixing ratio shown in the following table 1, in which a self-dispersion pigment is used for a pigment dispersion 1 and a resin dispersion pigment is used for a pigment dispersion 2. For each of the pigment dispersions 1 and 2, a fluid dispersion is prepared by adding water to a pigment so as to disperse the pigment such that the pigment concentration reaches 10 mass %. The preparation of each solvent is shown in the following table 1.

TABLE 1

Ink composition in the example

| | Ink Preparation (mass %) | |
|---|---|---|
| | 1 | 2 |
| Pigment dispersion 1 | 50 | |
| Pigment dispersion 2 | | 50 |
| Glycerin | 5 | 5 |
| Polyethyleneglycol 600 | 15 | 15 |
| 2-pyrrolidone | 5 | 5 |
| Acetylene glycol EO adduct | 0.1 | 0.1 |
| Pure water | 24.9 | 24.9 |

The pigment ink filled into the ink cartridge has desirably a smaller specific gravity than that of the swinging member. The swinging member in the example, which is formed of a stainless material, has a specific gravity of 8.0 g/cm$^3$, and the specific gravity of the pigment ink ranges from 1.0 g/cm$^3$ to 1.1 g/cm$^3$, which is thus smaller than that of the swinging member.

(Modified Example of Stirring Mechanism)

The stirring mechanism is not limited to the foregoing, and the cross-section of the hollow portion 204 is not limited to an elliptical shape and may be a circular shape, a rectangular shape or the like. The support 201 may be shaped so as to extend through the swinging member 200 rather than the recessed shape described above. In addition, the location of the support 201 is not necessarily determined to be on the long axis of the hollow portion 204 as described above.

Figure 8:
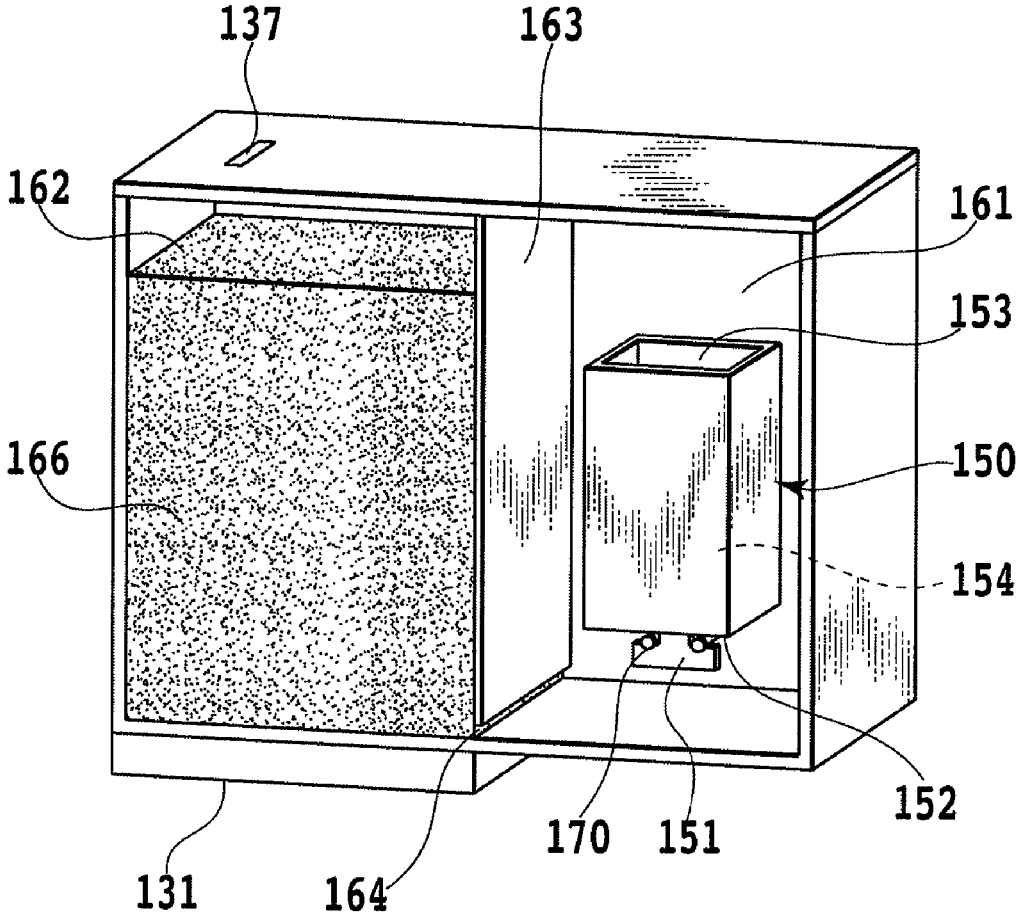
FIG. 8 is a perspective view of the principal part for illustrating an exemplary modification of the swinging member in the first embodiment of the present invention.

FIG. 8 is a view illustrating a modified example of the stirring mechanism.

A stirring member 150 in the example is shaped three-dimensionally such that the shape of each of apertures 152 and 153 and the cross-section of a hollow portion 154 are rectangular. A support 151 is provided in the lower portion of the stirring member 150, and has two sides engaged with projections 170 provided on the inner wall of an ink storage chamber 161. Thus, the swinging member 150 is supported by the projections 170 in such a manner as to swing about the projections 170 as fulcrums. The head of each projection 170 has a greater diameter so as to prevent the support 151 of the swinging member 150 from coming away. The projections 170 serve as the swinging fulcrums of the swinging member 150 and also permit the swinging member 150 to slide in the axis direction of the projection 170.

The inside of the ink cartridge 1 is divided into an ink storage chamber 161 and a negative-pressure generating chamber 162 by a partition 163 having a linking portion 164 at the lower end. The negative-pressure generating chamber 162 houses a negative-pressure generating member 166 that is made of a polypropylene textile material and generates a capillary force. When the ink is consumed through a supply port 131 by the printing head, the air introduced through an atmospheric communication port 137 into the negative-pressure chamber 162 and the ink in the ink storage chamber 161 are exchanged through the linking portion 164.

(Method for Loading Ink)

Figure 9A:
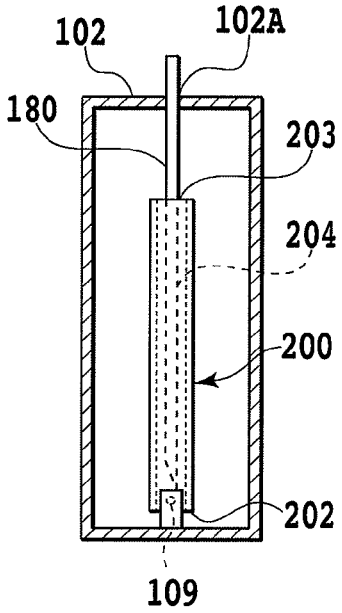
FIG. 9A, FIG. 9B and FIG. 9C are sectional views each showing an ink cartridge for illustrating a method for loading ink into the ink cartridge shown in FIG. 6.
Figure 9B:
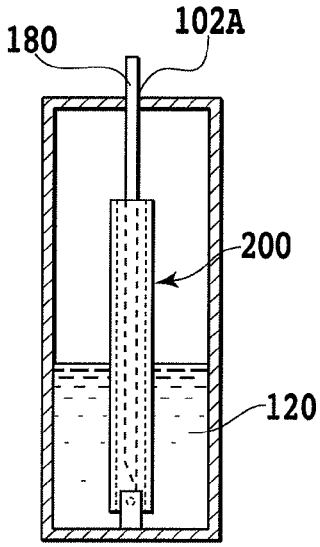
Figure 9C:
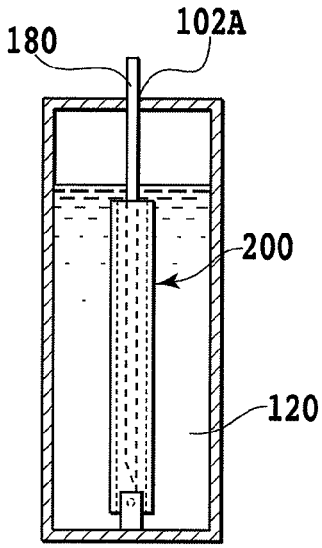

FIG. 9A, FIG. 9B and FIG. 9C are sectional elevation views each showing the aforementioned ink cartridge for illustrating a method for loading ink into the ink cartridge, which are taken along the IX-IX line in FIG. 4.

After the ink in the ink cartridge has been consumed or when the ink cartridge is initially loaded with ink, an infusion needle 180 is inserted into the ink cartridge 1 as shown in FIG. 9A. The infusion needle 180 is a needle-shaped hollow member having an ink passageway formed therein, and having a base end (the upper end in FIG. 9A) connected to an ink supply source which is not shown, and a leading open end (the lower end in FIG. 9A). In order to insert the infusion needle 180 into the ink cartridge 1, a hole 102A is drilled in the lid member 102, then the infusion needle 180 is inserted into the hole 102 from above in the gravity direction. Since the infusion needle 180 of the example has a sharply-pointed leading end, the leading end can also be plunged into the ink cartridge 1 so as to form the hole 102A. The method for forming the hole 102A is not limited to the method of using the infusion needle 180 or another means to form a hole when the ink is loaded as described above. For example, a hole may be drilled in advance in the ink cartridge 1 before the ink is loaded through the infusion needle 180. In this case, the pre-formed hole is unsealed at the time of loading the ink, and then the infusion needle 180 can be inserted through the hole. An important point is that a site enabling the insertion of the infusion needle 180 exists on the ink cartridge 1, and the location of the site is a location in which the ink can be loaded into the ink cartridge 1 as described later.

In the case of this example, the infusion needle 180 is inserted into the ink cartridge 1 so as to be located inside the hollow portion 204 of the swinging member 200, such that the leading end of the infusion needle 180 is located close to the bottom of the hollow portion 204.

After the infusion needle 180 has been inserted in this manner, the ink 120 is loaded through the infusion needle 180 into the ink cartridge 1. FIG. 9B shows a middle stage in the ink loading process. Then, when as shown in FIG. 9C, the hollow portion 204 of the swinging member 200 is filled with the ink 120 and the entire swinging member 200 is submerged in the ink 120, the ink loading process is complete. Then, the infusion needle 180 is removed and the hole 102A is sealed.

In the ink loading process, the ink 120 is loaded relatively quickly and smoothly so as to prevent the occurrence of bubbles. If the ink 120 includes a material causing the occurrence of bubbles such as a surface-active agent, bubbles easily occur. To avoid this, the ink 120 is loaded smoothly not to produce a vortex.

If bubbles occur in the ink 120 and adhere to the wall face of the ink storage chamber 161 and/or the swinging member 200, this may possibly result in the blocking of the ink flow to impair the full efficacy of the stirring when the ink is stirred through the stirring operation which will be described later. In particular, when bubbles adhere to the inner face of the swinging member 200 forming the hollow portion 204 (hereinafter referred to as "the inner face of the swinging member"), the bubbles may block the flow of the ink in the hollow portion 204 in the stirring operation which will be described later. Depending upon the relationship between the inner diameter of the hollow portion 204 and the size of the bubbles adhering to the inner face of the swinging member 200, the movement of the ink in the hollow portion 204, which will be described later, may possibly not occur. Accordingly, it is important to load the ink 120 in such a manner as to prevent bubbles from occurring, and in particular it is important to prevent the adhesion of bubbles to the inner face of the swinging member 200. Smoothly loading the ink so as to restrain bubbles from occurring or remaining is made possible by introducing ink through the infusion needle 180 from a site close to the bottom of the ink storage chamber 161 and from the inside of the hollow portion 204 as described in the example.

The ink loaded from the infusion needle 180 produces a flow traveling upward in the hollow portion 204 and a flow traveling toward the inside of the ink storage chamber 161 from the hollow portion 204 through the lower aperture 202. In the example, because the infusion needle 180 is located inside the hollow portion 204, the gap between the inner face of the swinging member 200 and the infusion needle 180 becomes narrow, which increases the velocity of the ink moving in the hollow portion 204. For this reason, when bubbles occur in the hollow portion 204, they can be removed from the hollow portion 204.

In the ink loading process, the gap between the infusion needle 180 and the hole 102A serves as an air vent to let the air in the ink storage chamber 161 escape to the outside. If bubbles occur in the ink loading process, the bubbles can be removed from the hole 201A to the outside by loading the ink 120 in such a manner as to overflow from the hole 201A.

In order to prevent the bubbles from remaining on the inner face of the swinging member 200, the inner face is desirably subjected to hydrophilic treatment. If the swinging member 200 is formed of stainless steel (SUS material), the inner face is desirably ground by a sandblasting technique or the like to restrain the adhesion of bubbles. If the swinging member 200 is formed of a resin material, the inner face is desirably subjected to hydrophilic treatment. The method for performing the hydrophilic treatment on the resin material may be chosen at will, and for example, a method as described in Japanese Patent Laid-Open No. 2001-220457 may be used.

The ink cartridge 1 is loaded with the ink 120 until the swinging member 200 is submerged in the ink, that is, until the liquid level of the ink extends above the upper aperture 203 in the gravity direction. Loading the ink 120 up to above the upper aperture 203 in the gravity direction means that the ink 120 is loaded into the ink cartridge 1 placed in a predetermined position up to a higher level than the upper aperture 203 in the gravity direction. The predetermined position refers to the mounted position (operating position) when the ink cartridge 1 is installed on the printing apparatus body M1000 which is placed on a plane forming approximately a right angles with the gravity direction (an approximately horizontal plane). The ink 120 is loaded in an amount to reach or exceed a level for submerging the upper aperture 203 of the swinging member 200 in the ink when the ink cartridge 1 is in such a mounted position. It is essential that the ink 120 can be loaded to at least a level which allows the swinging member 200 to exercise its later-described stirring function when the ink cartridge is operated.

In the embodiment, in addition to the swinging movement of the swinging member 200 as described later, the ink flow traveling through the hollow portion 204 of the swinging member 200 is effectively used to stir the ink. For this end, the amount of loading the ink 120 is set to a level at least allowing it to be stirred by the swinging movement of the swinging member 200, preferably, a level inducing an ink flow traveling through the hollow portion 204 of the swinging member 200. For inducing such an ink flow, a desirable loading amount is equal to or greater than a level for submerging the upper aperture 203 in the ink 120 (a level for completely submerging the hollow portion 204 in the ink 120). However, if a loading amount of ink less than the above level can induce the occurrence of an ink flow in the hollow portion 204 or the swinging movement of the swinging member involving the stirring of the ink, the loading amount may be a level such as to submerge at least a part of the hollowing portion 204 in the ink 120.

In the example, the position of the ink cartridge 1 when the ink is loaded (ink-loaded position) is the same as the mounted position of the ink cartridge 1 in operation. However, the ink-loaded position is not necessarily the same as the mounted position. For the ink-loaded position of the ink cartridge 1, one effective for reducing the amount of bubbles occurring and/or remaining can be selected in accordance with the size and/or shape of the ink cartridge 1 and/or the swinging member 200. In addition, the ink-loaded position is not necessarily limited to the one, and may be continuously or gradually changed in step with the process of loading the ink. For example, at the time of starting loading the ink, the ink-loaded position may be set to be a position inclined with respect to the mounted position (inclined position). Then, the ink-loaded position may be changed in step with the process of loading the ink, such that the ink cartridge 1 comes into an inverted position at the end of loading the ink. The importance is that the ink-loaded position can allow the ink to be loaded so as to reduce the amount of bubbles occurring and/or remaining. The positional relationship between the ink cartridge 1 and the infusion needle 180 can be maintained by changing the position of the infusion needle 180 in synchronization with the position of the ink cartridge 1.

(Other Examples of Method of Loading Ink)

Figure 10A:
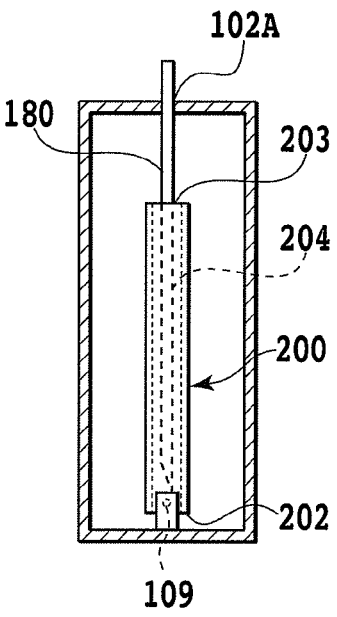
FIG. 10A, FIG. 10B and FIG. 10C are sectional views each showing an ink cartridge for illustrating another example of a method for loading ink into the ink cartridge shown in FIG. 6.
Figure 10B:
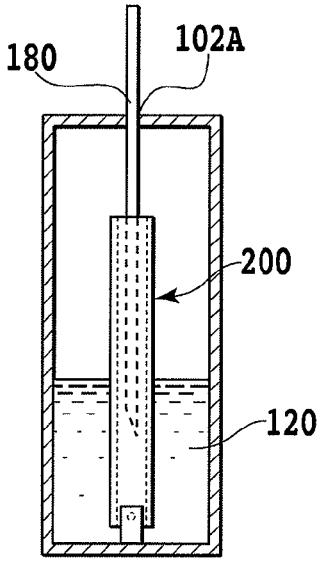
Figure 10C:
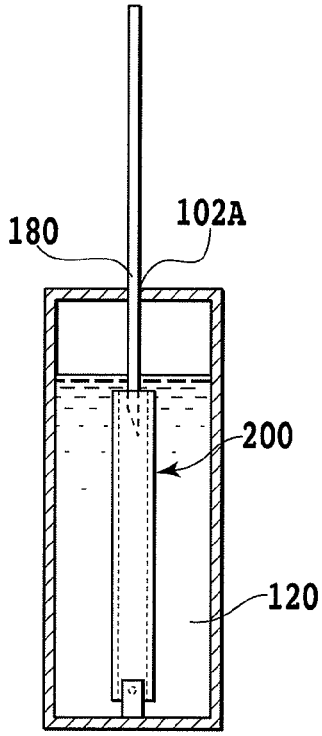

In the case of the method of loading ink illustrated in FIGS. 9A, 9B and 9C, while fixing the infusion needle 180 located in the ink cartridge 1, the ink is loaded through the infusion needle 180. However, as illustrated in FIG. 10A, FIG. 10B and FIG. 10C, the ink may be loaded through the infusion needle 180 while moving the infusion needle 180 gradually upward in step with the rise in the liquid level of the ink 120. In this manner, by moving the infusion needle 180 upward while the ink 120 is being loaded into the hollow portion 204, a reduction in the amount of bubbles remaining in the hollow portion 204 is made possible.

Figure 11A:
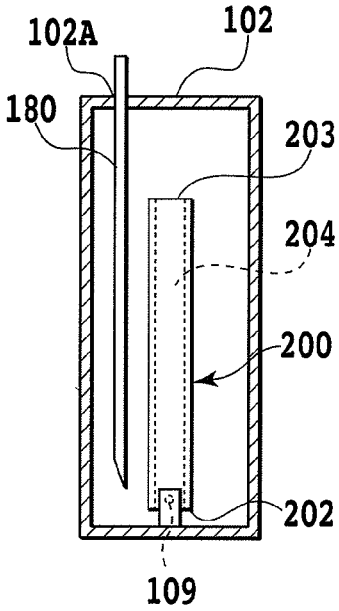
FIG. 11A, FIG. 11B and FIG. 11C are sectional views each showing an ink cartridge for illustrating still another example of a method for loading ink into the ink cartridge shown in FIG. 6.
Figure 11B:
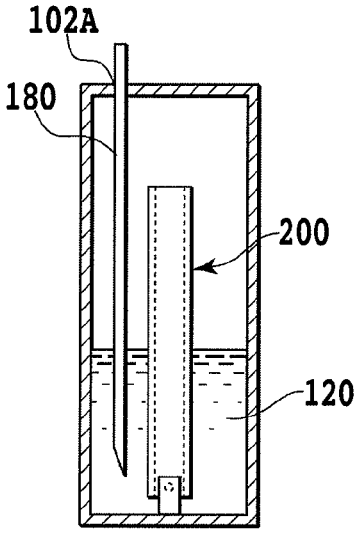
Figure 11C:
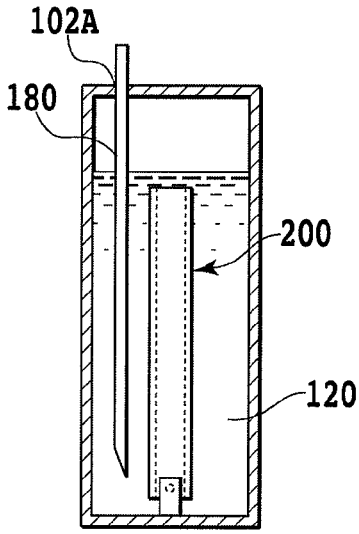

As illustrated in FIG. 11A, FIG. 11B and FIG. 11C, the infusion needle 180 may be inserted into a location outside the hollow portion 204 of the swinging member 200. In this case, the hollow portion 204 is loaded with ink from the outside of the swinging member 200. It is important again in this case to disallow bubble existing in the hollow portion 204. For this end, the inside of the swinging member 200 is desirably subjected to hydrophilic treatment. Also, in this example, the ink may be loaded through the infusion needle 180 while moving the infusion needle 180 gradually upward in step with the rise in the liquid level of the ink 120, as in the case of FIGS. 10A, 10B and 10C.

(Operation and Effect of Stirring Mechanism)

FIG. 12A to FIG. 12D are schematic structural diagrams each showing the principal part of the printing apparatus for illustrating the operation of the carriage in FIG. 2. FIG. 13A to FIG. 13H are illustrative views each showing the operation of the swinging member 200 and an ink flow occurring in the hollow portion 204 of the swinging member 200 in the example, which represent the condition of stirring a high-pigment-concentration portion of the ink settling on the bottom of the ink cartridge 1. FIG. 13A to FIG. 13H respectively correspond to a sectional view taken along the IX-IX line in FIG. 4.

The operation of the carriage M4001 mounted with the ink cartridge 1 which is the liquid container will be described first with reference to FIG. 12A to FIG. 12D.

Figure 12A:
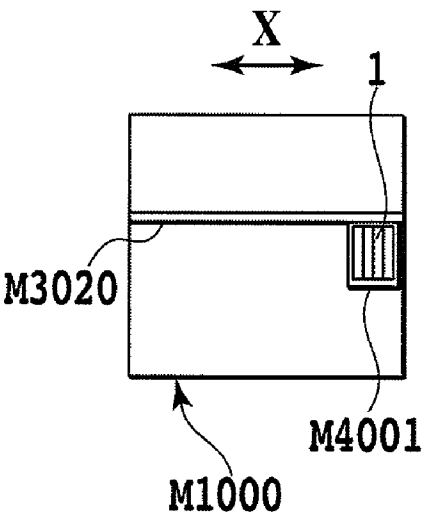
FIG. 12A, FIG. 12B, FIG. 12C and FIG. 12D are schematic structural diagrams each showing the principal part of the printing apparatus for illustrating the operation of the carriage in FIG. 2.
Figure 12B:
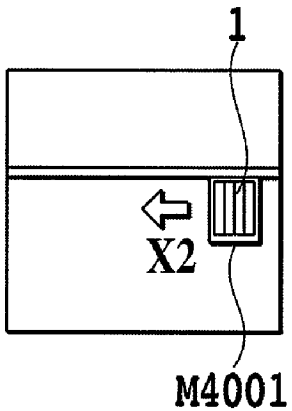
Figure 12C:
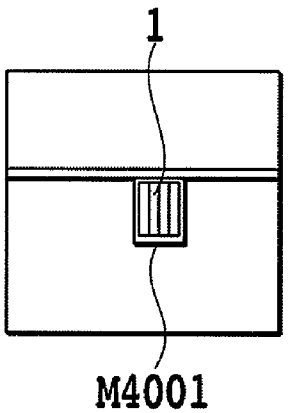
Figure 12D:
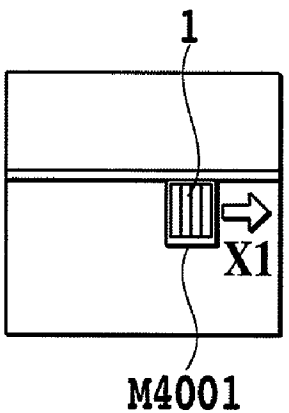

The carriage M4001 moves from its home position shown in FIG. 12A along a carriage shaft M3020 provided on the chassis of the printing apparatus M1000 in the direction indicated by the arrow X2 (see FIG. 12B). Then, the carriage M4001 is moved by a distance corresponding to the printing width of the printing medium or by a distance required for operating the swinging member 200, to reach a point shown in FIG. 12C. Then, the moving direction of the carriage M4001 is reversed at the point, so that the carriage M4001 is then moved from there in the direction indicated with the arrow X1 (see FIG. 12D). The moving direction of the carriage M4001 is reversed again at the point shown in FIG. 12A, and then the carriage M4001 repeats the reciprocating movement in the directions indicated with the arrows X times as required for printing. When the moving direction is reversed, the carriage M4001 is decelerated, stopped and accelerated in the reversed direction. As described above, prior to the reciprocating movement of the carriage M4001 for printing, as illustrated in FIG. 12B to FIG. 12D, the carriage M4001 makes at least one return trip in the example. As a result, it is possible to stir the ink prior to the printing operation as described later.

Next, the operation of the swinging member 200 of the ink cartridge 1 along with the reciprocating movement of the carriage M4001 will be described with reference to FIG. 13A to FIG. 13H. The ink storage chamber 111 shown in these figures is in the condition of being loaded with the ink.

FIG. 13A shows the state of the carriage M4001 which is at rest in its home position as shown in FIG. 12A, in which the swinging member 200 in the ink storage chamber 111 is at rest while the outer side of the upper aperture 203 is in contact with the inner wall of the ink storage chamber 111. This state is held from the time when the carriage M4001 starts moving from the point shown in FIG. 12A until when it moves at the constant speed in the direction X2 as shown in FIG. 12B.

FIG. 13B to FIG. 13E illustrate the state either when the carriage M4001 reaches the point shown in FIG. 12C and then its moving direction is reversed from the direction X2 to the direction X1 or when the carriage M4001 is moving in the direction X1 after the reverse of the moving direction as shown in FIG. 12D. When the moving direction of the carriage M4001 is reversed, an inertial force acts on the ink cartridge 1. When the inertial force acts in the direction indicated by the arrow X2, that is, when the moving direction of the carriage M4001 is reversed from the direction X2 to the direction X1, the swinging member 200 swings about the support 201 as a fulcrum in the direction indicated with the arrow S2 in the order illustrated in FIG. 13B to FIG. 13E. Then, as shown in FIG. 13E, the outer side of upper aperture 203 of the swinging member 200 comes into contact with the opposite inner wall of the ink storage chamber 111 (the inner wall opposite to the inner wall which is in contact with the outer side of the upper aperture 203 in FIG. 13A), thereby stopping the swinging motion of the swinging member 200 in the direction S2. The swinging member 200 is kept in the state shown in FIG. 13E from the time when the carriage M4001 starts moving from the point of FIG. 12C to the time when it moves at a constant speed in the direction X2 as shown in FIG. 12D.

FIG. 13F and FIG. 13G illustrate the sate either when the carriage M4001 moves in the direction X1 to reach the point of FIG. 12A and then reverses the moving direction to the direction X2 or when the carriage M4001 is moving in the direction X2 after the reverse of the moving direction as shown in FIG. 12B. When an inertial force associated with the reverse of the moving direction of the carriage M4001 acts in the direction indicated by the arrow X1, the swinging member 200 swings about the support 201 as the fulcrum in the direction indicated by the arrow S1, in the order shown in FIG. 13F and FIG. 13G. Then, the carriage M4001 moves again in the direction X1, whereby the swinging member 200 swings in the direction S2 as shown in FIG. 13H.

The swinging member 200 repeats the reciprocating movement as described above while the carriage M4001 repeats the reciprocating movement.

Next, a description with reference to FIG. 13A to FIG. 13H will given of the conditions of an ink flow occurring in the hollow portion 204 of the swinging member 200 in association with the reciprocating movement of the swinging member 200 and of the ink stirred.

The swinging member 200 starts swinging in the direction S2, and then a centrifugal force generated by the swinging movement of the swinging member 200 produces a flow T2 of the ink existing in the hollow portion 204 to go out from the upper aperture 203 as shown in FIG. 13B. At the same time, a flow T1 going into the hollow portion 204 occurs in the ink existing on the bottom of the ink tank around the lower aperture 202. With the continuation of the swinging movement of the swinging member 200, the centrifugal force acting on the ink in the hollow portion 204 causes the ink to flow through the hollow portion 204 to outflow from the upper aperture 203, as shown in from FIG. 13B to FIG. 13D.

As shown in FIG. 13E, the swinging movement of the swinging member 200 in the direction S2 is stopped, whereupon an inertial force generated by the stop of the swinging movement of the swinging member 200 acts on the ink in the hollow portion 204 so as to further accelerate the ink flow in the hollow portion 204. The portion of the ink, which has passed through the hollow portion 204 outflows from the upper aperture 203, becomes a flow T3 which then diffuses into a low-pigment-concentration portion of the ink, as shown in FIG. 13F and FIG. 13G. The ink in the ink storage chamber 111 is further stirred by a flow T4 of the ink bouncing off the inner face of the ink storage chamber 111.

The high-pigment-concentration portion of the ink, which has gone out from the upper aperture 203, moves down, due to the flows T2, T3, T4 and the gravity, to a level where the swinging member 200 is provided. Then, as shown in FIG. 13H, as the swinging member 200 swings, the relative distance between the outer wall of the swinging member 200 and the inner wall of the ink storage chamber 111 variously increases and decreases, thereby producing a mechanical flow T5 between these outer and inner walls. The flow T5 further stirs the ink in the ink storage chamber 111.

The operation as described above is carried out once or a plurality of times, whereby the ink in the ink storage chamber 111 is stirred by being moved upward from a lower portion to a higher portion by the flows T1 to T5. This results in even stir of the ink in the entire ink storage chamber 111 including the portion of the ink existing in the upper portion of the ink storage chamber 111. In short, it is possible to effectively stir the ink in the ink cartridge 1.

The swinging movement of the swinging member 200 is desirably carried out continuously. The continuous swinging movement can enhance a propulsive force required for stirring the ink in the ink storage chamber 111 toward the upper portion from the lower portion. In other words, it is possible to enhance the pumping effect producing a flow T2 of the ink in the hollow portion 204 of the swinging member 200.

In the example, the ink is stirred while the swinging member 200 is reversed in the swinging direction. However, the swinging direction is not necessarily reversed. What is required is that the inertial force can apply a propulsive force to the ink so that the pigment particles located on the bottom of the ink storage chamber travel through the hollow portion of the swinging member so as to rise up toward the upper portion of the ink cartridge. Accordingly, the swinging member may be stopped after moving in one direction. Also, even when the ink in the ink storage chamber 111 is decreased to lower the liquid level, as long as the hollow portion 204 of the swinging member 200 is submerged in the ink, it is possible to offer the ink stirring effects described above.

(Experimental Results)

For verifying the ink stirring effects, the inventors poured pigment ink into an ink cartridge until the hollow portion of the swinging member was submerged in the ink. Then, the ink cartridge was heated and maintained for the purpose of verifying the phenomenon of the pigment ink settling out in a short time. The ink cartridge was maintained at a temperature of 60° C. for 90 days. The ink cartridge after thus heated and maintained was placed in environment at ordinary temperatures to reduce the temperature. Then, without swinging the swinging member, a sample was obtained from the portion of the pigment ink located in a lower portion of the ink cartridge in the gravity direction. In another ink cartridge which has been heated and maintained as in the above case, the swinging member was first swung, and then a sample was obtained from the portion of the pigment ink located in the lower portion of the ink cartridge in the gravity direction. Then, the pigment concentrations of the pigment ink samples taken from the two ink cartridges were compared.

The following table 2 shows the pigment concentration of the pigment ink sample obtained from the heated and maintained ink cartridge without stirring the ink, and the pigment concentration of the pigment ink sample obtained from the heated and maintained ink cartridge after the ink had been stirred as described above. Table 2 shows the pigment concentrations indicated by absolute values when the pigment concentrations before the heating and maintaining process are defined as 100. As shown in Table 2, the pigment concentration when the ink has not been stirred is 170, and the pigment concentration when the ink has been stirred was less than 120. From this fact, it can be confirmed that performing the foregoing stirring method makes the pigment concentration of the ink closer to the pigment concentration measured before the heating and maintaining process.

TABLE 2

| Results of verification of the stirring by the swinging member | |
|---|---|
| | Pigment Concentration |
| Non-stir | 170 |
| Stirred | less than 120 |

Heating and maintaining 60° C., 90 days
Pigment Concentration before the heating and maintaining process is defined as 100

In the embodiment, the swinging member is designed to, upon swinging, make the moving velocity of the aperture forming in the lower portion slower than that of the aperture forming in the upper portion. Because of this, a flow of the ink from the lower layer in the ink cartridge toward the upper layer is produced. This ink flow induces convective mixing of the thick ink and the thin ink together in the ink cartridge to effectively stir the ink. This makes it possible to prevent the occurrence of a difference in density on the printed image between an initial stage and a later stage of the printing operation of the ink cartridge, and to prevent color balance from being lost when a plurality of color inks are used.

In any of the structures, a swinging member having a hollow portion is provided in a liquid container and is swung to guide the liquid in the hollow portion such that the liquid flows into the hollow portion from one end of the hollow portion and then flows out from the other end of the hollow portion. As a result, it is possible to produce a liquid flow effective for stirring the liquid in the liquid container.

As described in the embodiment, when a swinging fulcrum is provided in the vicinity of the aperture in the lower portion of the swinging member in the vertical direction, pigment particles apt to settle to the lower portion of the ink storage chamber can easily and reliably rise up to the upper portion. Specifically, by setting the swinging fulcrum in a location below the central portion of the swinging member in the vertical direction, the ink introduced from the aperture located in a lower portion in the gravity direction can be guided to the outside from the aperture located in an upper portion in the gravity direction. That is, it is possible to stir the ink by guiding the ink through the hollow portion from the bottom toward the above in the gravity direction. As a result, it is possible to effectively stir the entire liquid such as ink contained in the liquid container to reduce the concentration gradient of the liquid.

Second Embodiment

Next, a second embodiment of the present invention will be described. A liquid container in this embodiment is an example of the case when it is applied as an ink cartridge which is mountable on the printing apparatus illustrated in FIG. 1 to FIG. 3. In the ink cartridge of the embodiment, the volume of the ink storage chamber does not decrease even when the ink is consumed. In other words, the amount of ink in the ink storage chamber alone is decreased without a reduction in the volume of the ink storage chamber.

(Structure of Entire Ink Tank)

Figure 14:
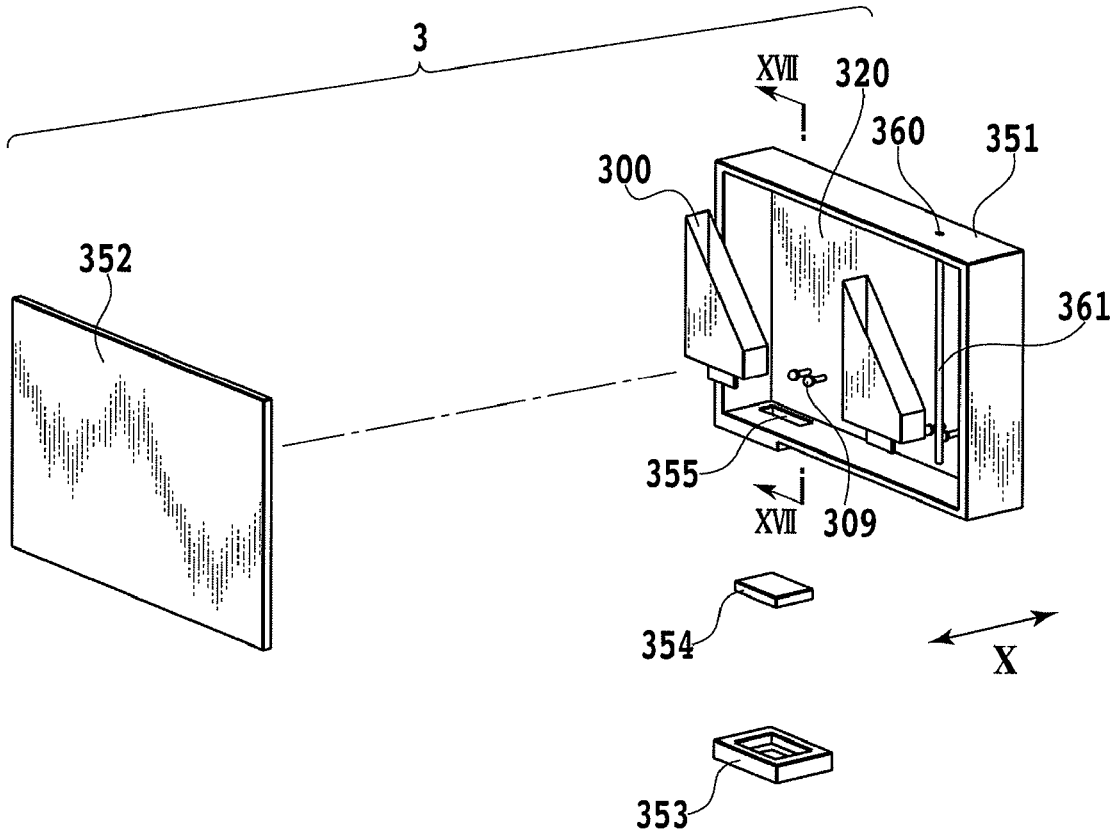
FIG. 14 is an exploded perspective view of an ink cartridge in a second embodiment of the present invention.

FIG. 14 is an exploded perspective view of an ink cartridge 3 of the example. The ink cartridge 3 is a container having an ink storage chamber 320 formed therein, which mainly comprises a container body 351 and a lid member 352. The ink cartridge 3 has an ink supply port 355 formed in the bottom for supplying the ink to the printing head.

The container body 351 is formed of, for example, polypropylene, and a swinging member 300 is accommodated in the container body 351 as a stirring member for stirring the ink. An opening of the container body 351 is covered with the lid member 352. Projections 309 are provided in the container body 351 for supporting the swinging member 300, and a meniscus producing member 354 is provided in the ink supply port 355. The meniscus producing member 354 and the inside of the container body 351 communicate with each other through an ink flow path, so that ink can be applied from the ink storage chamber 320 in the container body 351 to the printing head. An ink meniscus is produced in the meniscus producing member 354, to prevent bubbles from entering the container body 351 from the outside. The meniscus producing member 354 is secured by being pressed from the outside by a pressing member 353.

The container body 351 has an atmospheric communication port 360 for introducing air into the ink storage chamber 320. The ink storage chamber 320 is sealed not to allow air to enter and exit from the ink storage chamber 320 except for through the atmospheric communication port 360. A small tube 361, which is hollow, has one end connected to the atmospheric communication port 360 and the other end open to a lower portion of the ink storage chamber 320 near the bottom in the gravity direction. This structure allows air to enter the ink storage chamber 320 from the other end of the small tube 361 as the ink in the ink storage chamber 360 is consumed. A negative pressure is developed in the ink storage chamber 320 by a pressure reduction in the ink storage chamber 320 in association with the ink consumption and the ink meniscus in the small tube 361.

(Structure of Stirring Mechanism)

Figure 15:
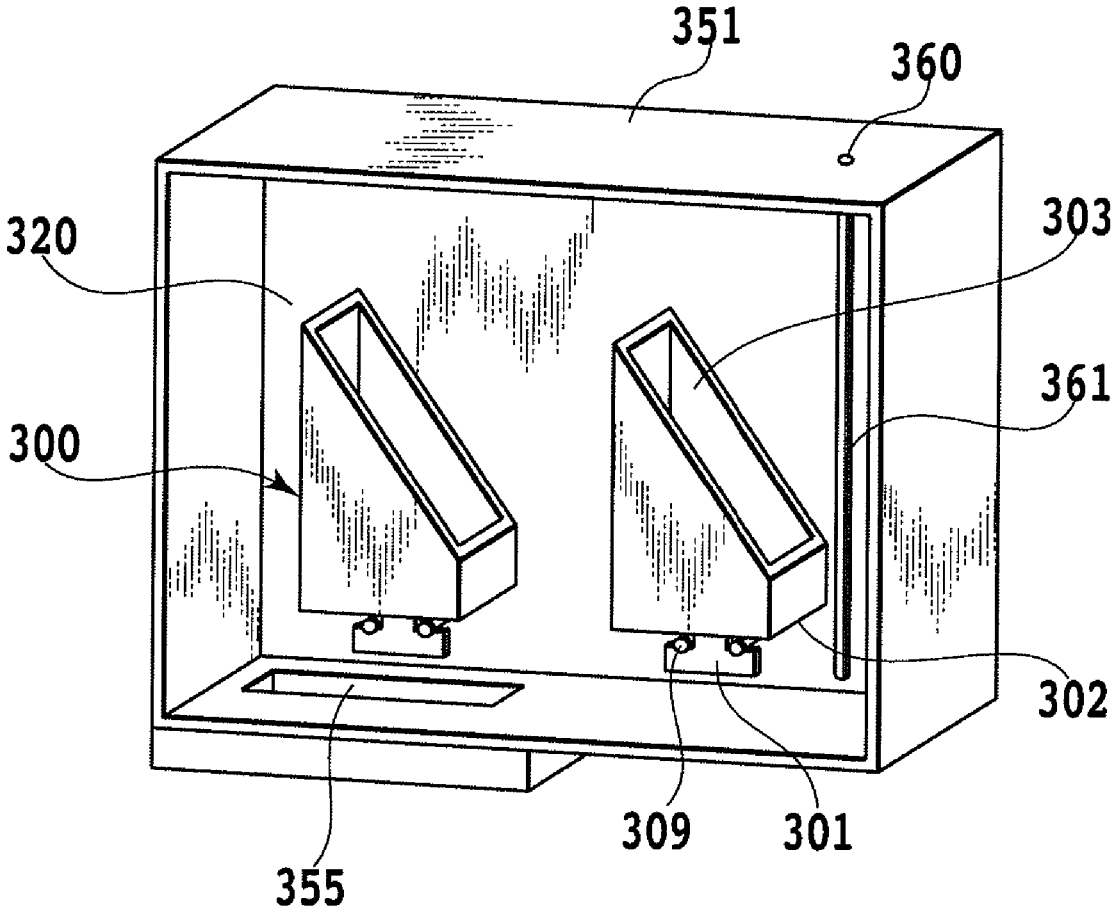
FIG. 15 is a perspective view of the principal part for illustrating the mounting of a swinging member in FIG. 14.
Figure 16:
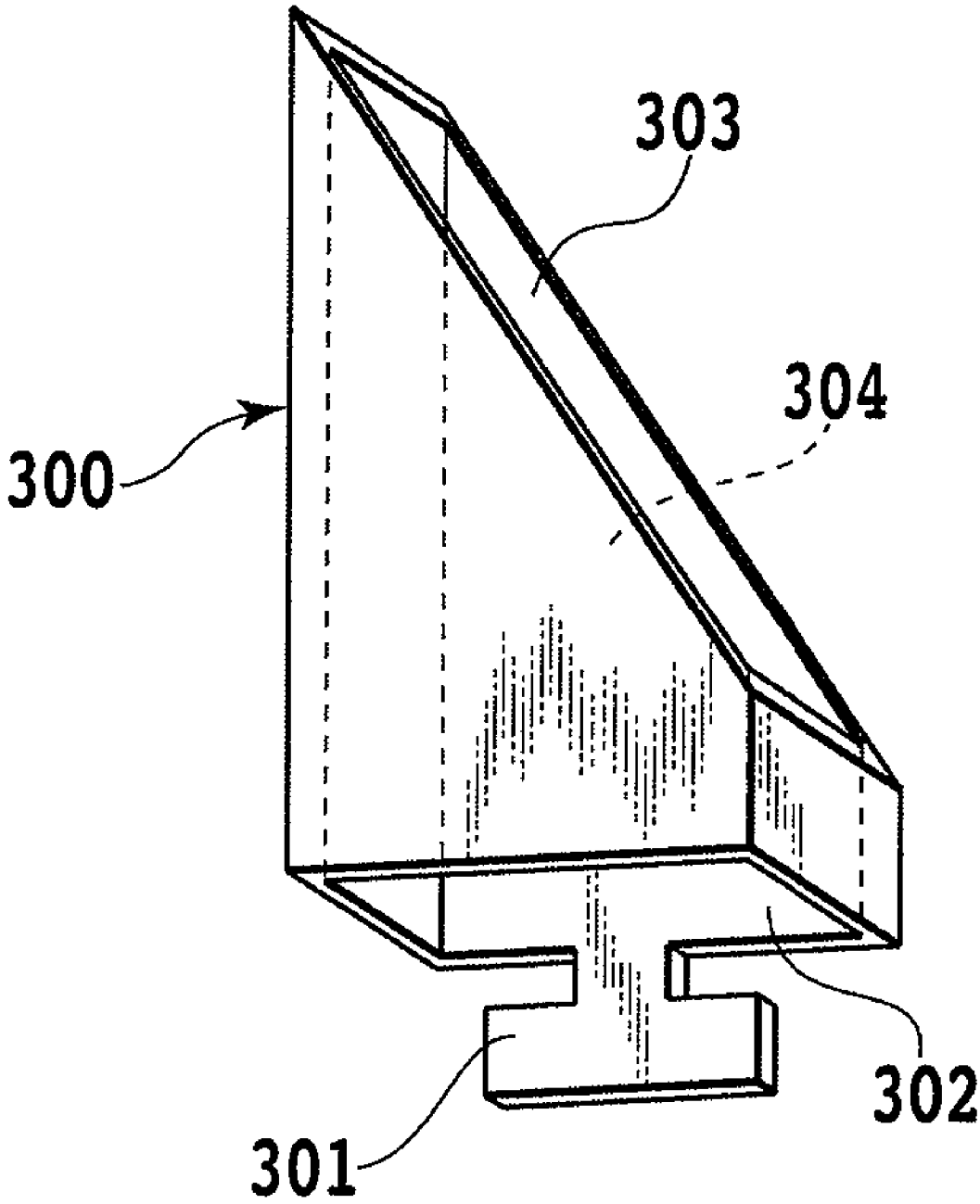
FIG. 16 is an enlarged perspective view of the swinging member in FIG. 14.

FIG. 15 is a perspective view for illustrating the mounting of the swinging member 300, and FIG. 16 is an enlarged perspective view of the swinging member 300.

A support 301 of the swinging member 300 has two sides engaged with projections 309 provided on the inner wall of the container body 351 in order to support the swinging member 300. The projections 309 serve fulcrums when the swinging member 300 swings. In the swinging member 300 a lower aperture 302 is formed in a lower portion in the gravity direction and an upper aperture 303 is formed in an upper portion, and a hollow portion 304 is formed between the apertures 302 and 303. The upper aperture 303 is vertically inclined with respect to the hollow portion 304 extending in the up-down direction. Such a swinging member 300 is shape three-dimensionally to form the hollow portion 304 in its interior.

Figures 18A, 18B, 18C:
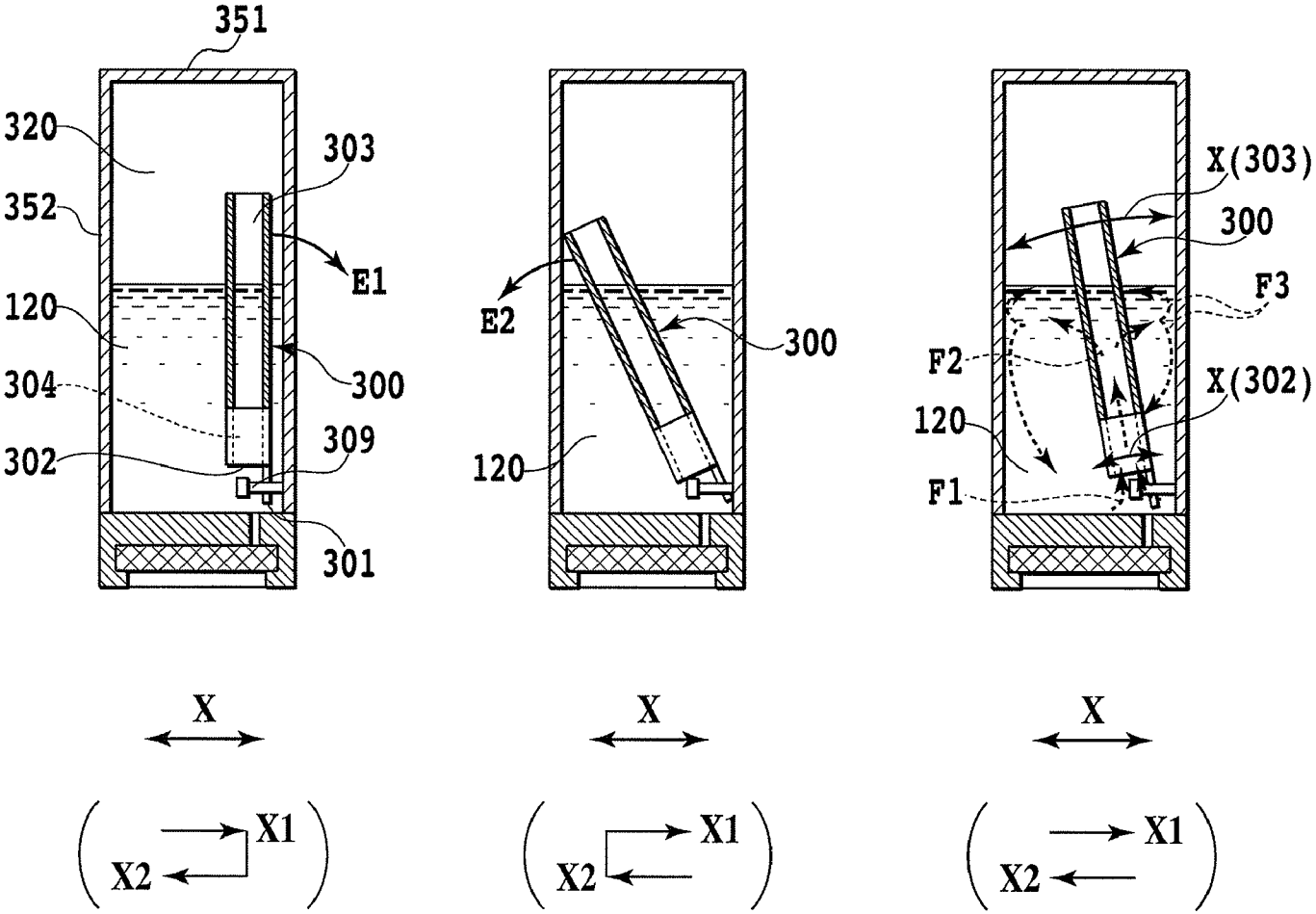
FIG. 18A, FIG. 18B and FIG. 18C are sectional views each showing an ink cartridge for illustrating the operation of the swinging member in FIG. 14.

The swinging member 300 in the example is supported on the projections 309 by the support 301 provided near the lower aperture 302. For this reason, when the swinging member 300 swings as shown in FIG. 18C, the amount of displacement at the upper aperture 303 is larger than that at the lower aperture 302. The swinging member 300 is formed of a stainless material. Note that the material used to form the swinging member 300 is not limited to the stainless material but needs to have a larger specific gravity than that of the ink contained in the ink storage chamber 320.

(Method for Loading Ink)

Figure 17A:
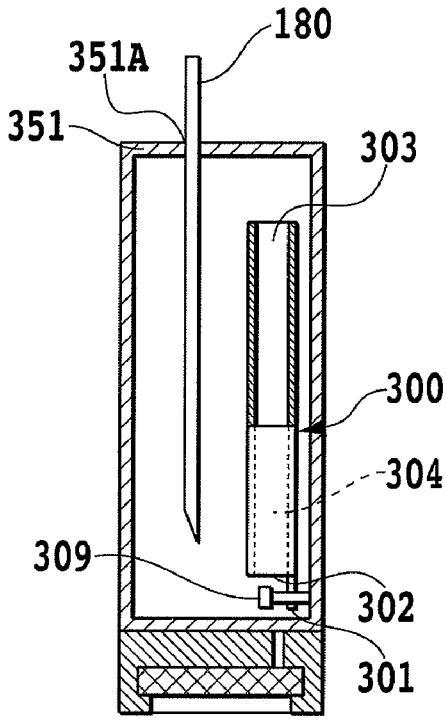
FIG. 17A and FIG. 17B are sectional views each showing an ink cartridge for illustrating a method for loading ink into the ink cartridge shown in FIG. 14.
Figure 17B:
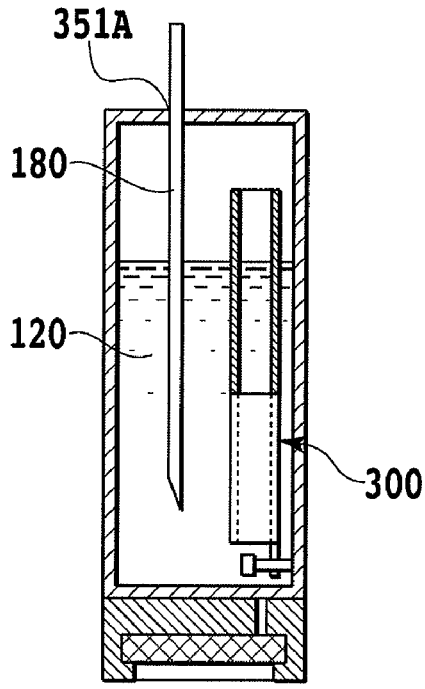

FIG. 17A and FIG. 17B are side-sectional elevation views each showing the aforementioned ink cartridge 3 for illustrating a method for loading ink into the ink cartridge 3 of the example, which correspond to the sectional views taken along the XVII-XVII line in FIG. 14.

As in the case of the foregoing first embodiment, after the ink in the ink cartridge has been consumed or when the ink cartridge is initially loaded with ink, the infusion needle 180 is inserted into the ink cartridge 3 as shown in FIG. 17A.

In the case of the example, the infusion needle 180 is inserted into the ink cartridge 3 in such a manner as to be located outside the hollow portion 304 of the swinging member 300, such that the leading end of the infusion needle 180 is located close to the bottom of the ink storage chamber 320.

After the infusion needle 180 has been thus inserted as in the case of the aforementioned illustration in FIGS. 11A, 11B and 11C, the ink 120 is loaded through the infusion needle 180 into the ink cartridge 3. Then, as shown in FIG. 17B, the ink 120 is loaded until at least a part of the upper aperture 303 of the swinging member 300 is submerged in the ink. Then, the infusion needle 180 is removed and a hole 351A is sealed.

In the ink loading process, the ink 120 is loaded relatively quickly and smoothly so as to prevent the occurrence of bubbles, as in the case of the aforementioned embodiment. If the ink 120 includes a material causing the occurrence of bubbles such as a surface-active agent, bubbles easily occur. To avoid this, the ink 120 is loaded smoothly not to produce a vortex.

The ink cartridge 3 is loaded with the ink 120 until at least a part of the upper aperture 303 of the swinging member 300 is submerged in the ink. Loading the ink 120 until at leas a part of the upper aperture 303 is submerged in the ink means that the ink 120 is loaded into the ink cartridge 3 in a predetermined position until at leas a part of the upper aperture 303 is submerged in the ink. The predetermined position refers to the mounted position (operating position) when the ink cartridge 3 is installed on the printing apparatus body M1000 which is placed on a plane forming approximately a right angles with the gravity direction (an approximately horizontal plane). The ink 120 is loaded in an amount to reach or exceed a level for submerging at leas a part of the upper aperture 303 of the swinging member 300 in the ink when the ink cartridge 3 is in such a mounted position. It is essential that the ink 120 can be loaded to at least a level which allows the swinging member 300 to exercise its later-described stirring function when the ink cartridge 3 is operated.

As in the case of the foregoing embodiment, what is required is that the ink cartridge is loaded with the ink 120 to a level allowing, at least, the swinging member 300 to exercise its stirring function. Also, the ink cartridge when the ink is loaded is required to be in a position allowing the ink to be loaded in such a manner as to reduce the amount of bubbles occurring and/or remaining.

As in the case of the illustration of FIGS. 10A, 10B and 10C, in the example, the ink may be loaded through the infusion needle 180 while moving the infusion needle 180 gradually upward in step with the rise in the liquid level of the ink 120. As in the case of the illustration of FIGS. 9A, 9B and 9C, if the infusion needle 180 is inserted into the hollow portion 304 of the swinging member 300, the occurrence of bubbles can be more effectively prevented.

(Operation and Effect of Stirring Mechanism)

FIG. 18A to FIG. 18C are side-sectional views each showing the ink cartridge 3 for illustrating the operation of the swinging member 300 in the embodiment.

FIG. 18A illustrates a first mode of the swinging member 300. The carriage M4001 reciprocates in the main scan direction (the direction indicated by the arrow X) in a range corresponding to the printing width of the printing medium. Accordingly, when the moving direction is reversed, the carriage M4001 is decelerated, stopped and accelerated in the reversed direction. At this point, an inertial force acts on the ink cartridge 3. When the inertial force acts in the direction indicated by the arrow X1, that is, when the moving direction of the carriage M4001 is reversed from the direction of the arrow X1 to the direction of the arrow X2, the swinging member 300 pivots about the support 301 in the direction indicated by the arrow E1, as shown in FIG. 18A. At this point, the outer side of the upper aperture 303 produces displacement in the direction coming into contact with the inner wall of the container body 351 on which the projections 309 are provided. When the inertial force acts in the direction X1 as described above, this state is referred to as a first mode. After the moving direction of the carriage M4001 has been reversed from the direction X1 to the direction X2, when the carriage M4001 moves at the constant speed in the direction X2, the inertial force becomes inoperative. As a result, the swinging member 300 is left in the first mode.

FIG. 18B illustrates a second mode of the swinging member 300. Contrary to the first mode, in the second mode, when the inertial force acts in the direction X2, that is, when the moving direction of the carriage M4001 is reversed from the direction X2 to the direction X1, the swinging member 300 pivots about the support 301 in the direction indicated by the arrow E2, as shown in FIG. 18B. At this point, the outer side of the upper aperture 303 produces displacement in the direction coming into contact with the lid member 352. When the inertial force acts in the direction X2 as described above, this state is referred to as the second mode. After the moving direction of the carriage M4001 has been reversed from the direction X2 to the direction X1, when the carriage M4001 moves at the constant speed in the direction X1, the inertial force becomes inoperative. As a result, the swinging member 300 is left in the second mode.

Because the carriage M4001 repeats the reciprocating movement in step with the printing operation or the operation of stirring the ink, the swinging member 300 is repeatedly put into the first mode and the second mode shown in FIGS. 18A and 18B to stir the ink in the ink storage chamber 320.

FIG. 18C illustrates the direction of displacement and the amount of displacement of the apertures 302 and 303 when the swinging member 300 swings, and the flow of the ink.

As described above, the amount of displacement X (303) of the upper aperture 303 produced when the swinging member 300 swings is larger than the amount of displacement X (302) of the lower aperture 302. If at least a part of the upper aperture 303, the lower aperture 302 and the hollow portion 304 are submerged in the ink, ink flows F1 and F2 are produced from the lower aperture 302 through the hollow portion 304 toward the upper aperture 303, and also an ink flow F3 associated with the flows F1 and F2 is produced. These ink flows can be utilized to stir the ink in the ink storage chamber 320.

Third Embodiment

Next, a third embodiment of the present invention will be described. A liquid container in this embodiment is an example of the case when it is applied as an ink cartridge which is mountable on the printing apparatus illustrated in FIG. 1 to FIG. 3. In the ink cartridge of the embodiment, the volume of an ink storage chamber does not decrease even when the ink is consumed. In other words, the amount of ink in the ink storage chamber alone is decreased without a reduction in the volume of the ink storage chamber.

(Structure of Entire Ink Cartridge)

Figure 19:
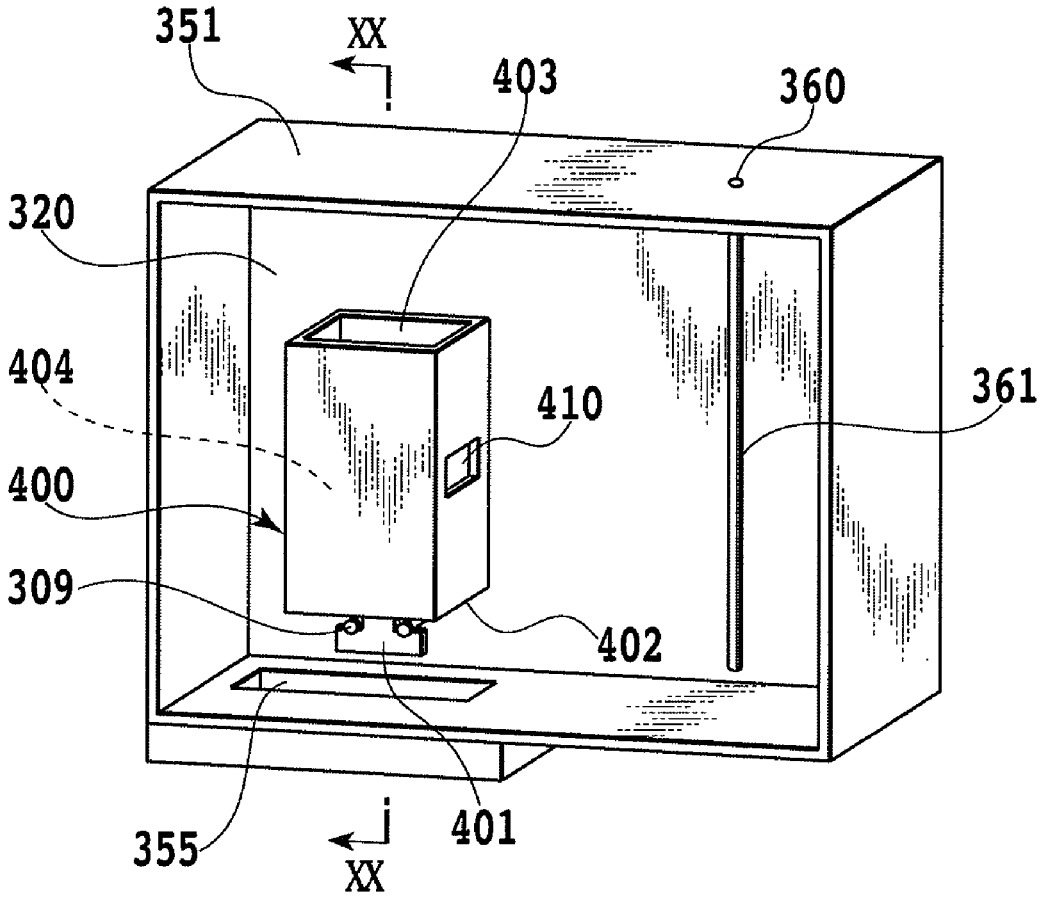
FIG. 19 is a perspective view of the principal part for illustrating the mounting of a swinging member in a third embodiment of the present invention.

FIG. 19 is an exploded perspective view of an ink cartridge of the example. The ink cartridge of the example differs in the structure of a swinging member provided therein from the ink cartridge described in FIG. 14, and has the same structure of other components as that of the ink cartridge of FIG. 14.

(Structure of Stirring Mechanism)

A support 401 of a swinging member 400 provided in the ink cartridge of the example has two sides engaged with projections 309 provided on the inner wall of the container body 351 in order to support the swinging member 400. The projections 309 serve fulcrums when the swinging member 400 swings. In the swinging member 400 a lower aperture 402 is formed in a lower portion in the gravity direction and an upper aperture 403 is formed in an upper portion, and a hollow portion 404 formed between the apertures 402 and 403. An intermediate aperture 410 is provided between the lower aperture 402 and the upper aperture 403 and communicates with the hollow portion 404. Such a swinging member 400 is shape three-dimensionally to form the hollow portion 404 in its interior.

(Method for Loading Ink)

Figure 20A:
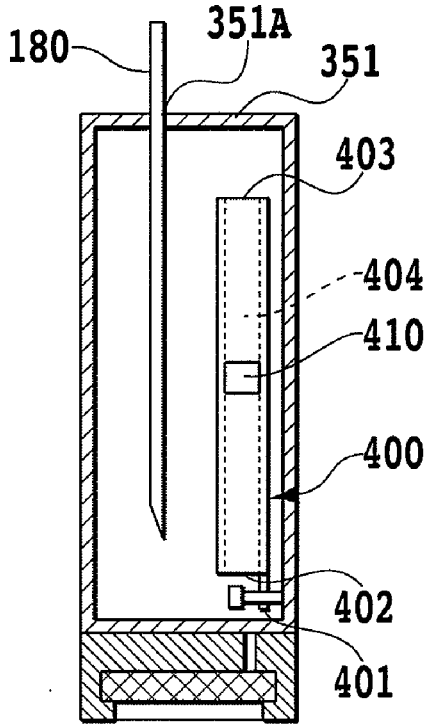
FIG. 20A and FIG. 20B are sectional views each showing an ink cartridge for illustrating a method for loading ink into the ink cartridge shown in FIG. 19.
Figure 20B:
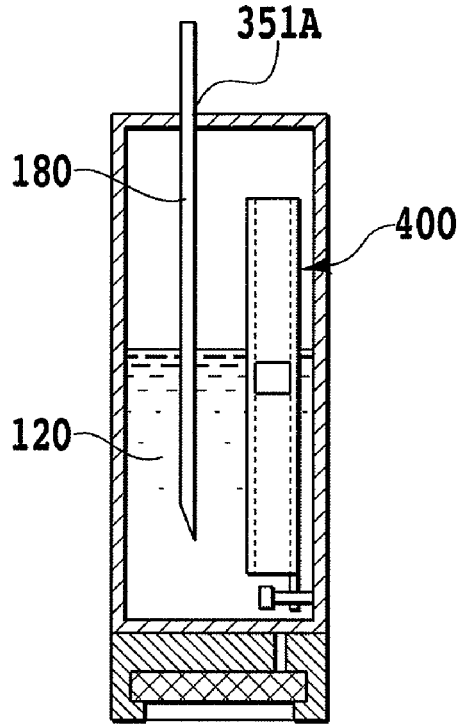

FIG. 20A and FIG. 20B are side-sectional elevation views each showing the ink cartridge for illustrating a method for loading ink into the ink cartridge of the example, which correspond to the sectional views taken along the XX-XX line in FIG. 19.

As in the case of the foregoing embodiments, after the ink in the ink cartridge has been consumed or when the ink cartridge is initially loaded with ink, the infusion needle 180 is inserted into the ink cartridge as shown in FIG. 20A. For the insertion of the infusion needle 180 into the ink cartridge, the hole 351A is drilled in the container body 351, and then the infusion needle 180 is inserted into the hole 351A from above in the gravity direction. The method of inserting the infusion needle 180 is not limited to the method of drilling the hole 351A in the ink cartridge and then inserting the infusion needle 180 as described above. For example, a hole provided in an ink cartridge in advance may be unsealed and then the infusion needle 180 may be inserted through the hole into the ink cartridge.

In the case of the example, the infusion needle 180 is inserted into the ink cartridge in such a manner as to be located outside the hollow portion 404 of the swinging member 400, such that the leading end of the infusion needle 180 is located close to the bottom of the ink storage chamber 320.

After the infusion needle 180 has been thus inserted as in the case of the aforementioned illustration in FIGS. 17A and 17B, the ink 120 is loaded through the infusion needle 180 into the ink cartridge. Then, as shown in FIG. 20B, the ink 120 is loaded until at least a part of the intermediate aperture 410 is submerged in the ink. Then, the infusion needle 180 is removed and the hole 351A is sealed.

In the ink loading process, the ink 120 is loaded relatively quickly and smoothly so as to prevent the occurrence of bubbles, as in the case of the aforementioned embodiment. If the ink 120 includes a material causing the occurrence of bubbles such as a surface-active agent, bubbles easily occur. To avoid this, the ink 120 is loaded smoothly not to produce a vortex.

As in the case of the foregoing embodiment, what is required is that the ink cartridge is loaded with the ink 120 to a level allowing, at least, the swinging member 300 to exercise its stirring function. Also, the ink cartridge when the ink is loaded is required to be in a position allowing the ink to be loaded in such a manner as to reduce the amount of bubbles occurring and/or remaining.

As in the case of the illustration of FIGS. 10A, 10B and 10C, in the example, the ink may be loaded through the infusion needle 180 while moving the infusion needle 180 gradually upward in step with the rise in the liquid level of the ink 120. As in the case of the illustration of FIGS. 9A, 9B and 9C, if the infusion needle 180 is inserted into the hollow portion 404 of the swinging member 400, the occurrence of bubbles can be more effectively prevented.

(Operation and Effect of Stirring Mechanism)

The swinging member 400 of the example swings about the support 401 provided at the lower end, whereby, as in the case of the foregoing embodiments, an ink flow is produced from the lower aperture 402 through the hollow portion 404 toward the upper aperture 403, to stir the ink 120. At this point, the intermediate aperture 410 can be operative to function similarly to the upper aperture 403. The intermediate aperture 410 is capable of functioning as a substitute for the upper aperture 403 when the amount of ink remaining in the ink storage chamber 320 is reduced. It should be noted that the formation number, the shape, and the formation location of the intermediate aperture 410 may be selected as appropriate as long as they communicate with the hollow portion 404.

Fourth Embodiment

Next, a fourth embodiment of the present invention will be described. A liquid container in this embodiment is an example of the case when it is applied as an ink cartridge which is mountable on the printing apparatus illustrated in FIG. 1 to FIG. 3. In the ink cartridge of the embodiment, the volume of an ink storage chamber does not decrease even when the ink is consumed. In other words, the amount of ink in the ink storage chamber alone is decreased without a reduction in the volume of the ink storage chamber.

(Structure of Entire Ink Cartridge)

Figure 21:
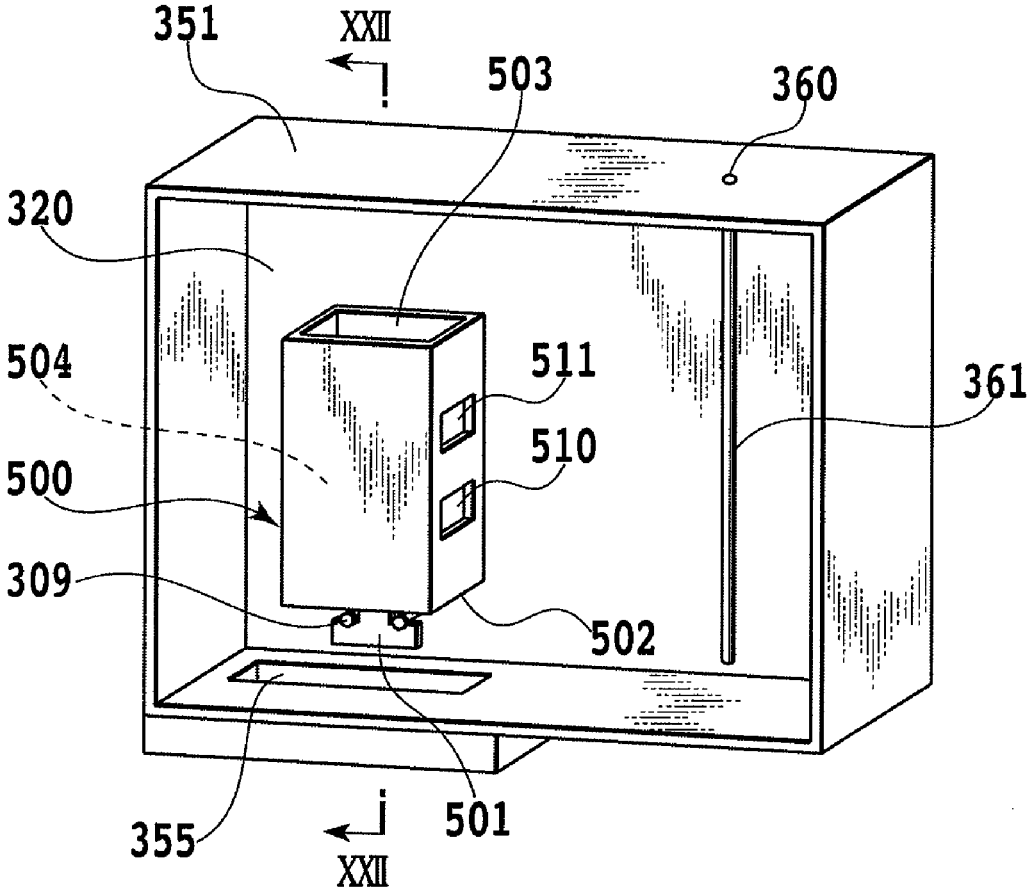
FIG. 21 is a perspective view of the principal part for illustrating the mounting of a swinging member in a fourth embodiment of the present invention.

FIG. 21 is an exploded perspective view of an ink cartridge of the example. The ink cartridge of the example differs in the structure of a swinging member provided therein from the ink cartridge described in FIG. 14, and has the same structure of other components as that of the ink cartridge of FIG. 14.

(Structure of Stirring Mechanism)

A support 501 of a swinging member 500 provided in the ink cartridge of the example has two sides engaged with projections 309 provided on the inner wall of the container body 351 in order to support the swinging member 500. The projections 309 serve fulcrums when the swinging member 500 swings. In the swinging member 500 a lower aperture 502 is formed in a lower portion in the gravity direction and an upper aperture 503 is formed in an upper portion, and a hollow portion 504 is formed between the apertures 502 and 503. First and second intermediate apertures 510 and 511 are provided between the lower aperture 502 and the upper aperture 503 and communicate with the hollow portion 504. The first intermediate aperture 510 is located in the lower side in the gravity direction and the second intermediate aperture 511 is located in the upper side in the gravity direction.

(Method for Loading Ink)

Figure 22A:
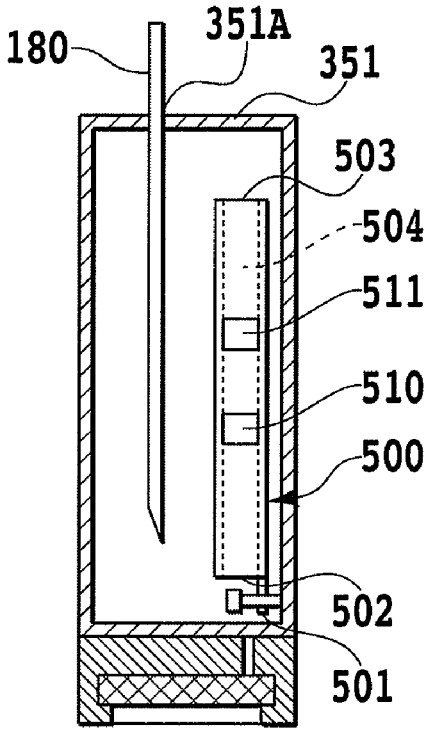
FIG. 22A and FIG. 22B are sectional views each showing an ink cartridge for illustrating a method for loading ink into the ink cartridge shown in FIG. 21.
Figure 22B:
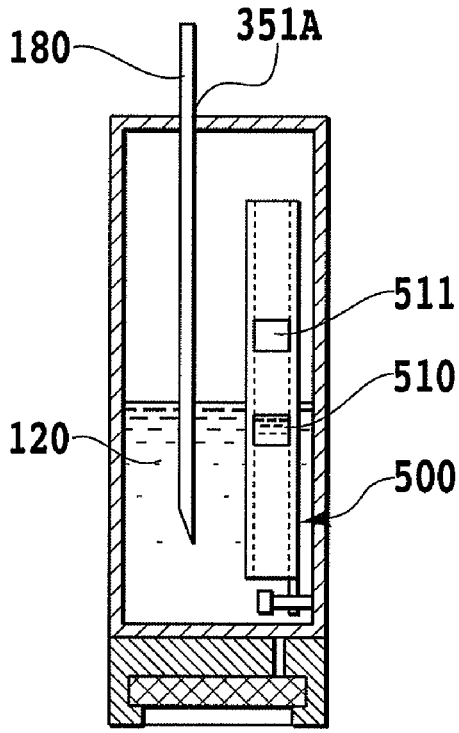

FIG. 22A and FIG. 22B are side-sectional elevation views each showing the ink cartridge for illustrating a method for loading ink into the ink cartridge of the example, which correspond to the sectional views taken along the XXII-XXII line in FIG. 21.

As in the case of the foregoing embodiments, after the ink in the ink cartridge has been consumed or when the ink cartridge is initially loaded with ink, the infusion needle 180 is inserted into the ink cartridge as shown in FIG. 22A. For the insertion of the infusion needle 180 into the ink cartridge, the hole 351A is drilled in the container body 351, and then the infusion needle 180 is inserted into the hole 351A from above in the gravity direction. The method of inserting the infusion needle 180 is not limited to the method of drilling the hole 351A in the ink cartridge and then inserting the infusion needle 180 as described above. For example, a hole provided in an ink cartridge in advance may be unsealed and then the infusion needle 180 may be inserted through the hole into the ink cartridge.

In the case of the example, the infusion needle 180 is inserted into the ink cartridge in such a manner as to be located outside the hollow portion 504 of the swinging member 500, such that the leading end of the infusion needle 180 is located close to the bottom of the ink storage chamber 320.

After the infusion needle 180 has been thus inserted as in the case of the aforementioned illustration in FIGS. 17A and 17B, the ink 120 is loaded through the infusion needle 180 into the ink cartridge. Then, as shown in FIG. 22B, the ink 120 is loaded until at least a part of the first intermediate aperture 510 is submerged in the ink. Then, the infusion needle 180 is removed and the hole 351A is sealed.

In the ink loading process, the ink 120 is loaded relatively quickly and smoothly so as to prevent the occurrence of bubbles, as in the case of the aforementioned embodiments. If the ink 120 includes a material causing the occurrence of bubbles such as a surface-active agent, bubbles easily occur. To avoid this, the ink 120 is loaded smoothly not to produce a vortex.

As in the case of the foregoing embodiments, what is required is that the ink cartridge is loaded with the ink 120 to a level allowing, at least, the swinging member 500 to exercise its stirring function. Also, the ink cartridge when the ink is loaded is required to be in a position allowing the ink to be loaded in such a manner as to reduce the amount of bubbles occurring and/or remaining.

As in the case of the illustration of FIGS. 10A, 10B and 10C, in the example, the ink may be loaded through the infusion needle 180 while moving the infusion needle 180 gradually upward in step with the rise in the liquid level of the ink 120. As in the case of the illustration of FIGS. 9A, 9B and 9C, when the infusion needle 180 is inserted into the hollow portion 504 of the swinging member 500, the occurrence of bubbles can be more effectively prevented.

(Operation and Effect of Stirring Mechanism)

The swinging member 500 of the example swings about the support 501 provided at the lower end, whereby, as in the case of the foregoing embodiments, an ink flow is produced from the lower aperture 502 through the hollow portion 504 toward the upper aperture 503, to stir the ink 120. At this point, the intermediate apertures 510 and 511 can be operative to function similarly to the upper aperture 503. For example, when the amount of ink remaining is reduced as shown in FIG. 22B, the first intermediate aperture 510 is capable of functioning as substitutes for the upper and second intermediate apertures 503 and 511. It should be noted that the formation number, the shape and the formation location of the first and second intermediate apertures 510 ad 511 may be selected as appropriate as long as they communicate with the hollow portion 504.

Other Embodiments

In the foregoing embodiments, the swinging member as the stirring member swings about a swinging fulcrum set at a point closer to the bottom in the gravity direction (point closer to the lower aperture), in order to produce a flow of liquid from the bottom to the above through the hollow portion of the swinging member. However, the swinging fulcrum may be set at a point closer to the top of the swinging member (point closer to the upper aperture). In this case, a difference between the moving velocities of the upper aperture and the lower aperture produces a flow of liquid from the above toward the bottom in the hollow portion of the swinging member, thus making it possible to stir the liquid as in the case of the foregoing embodiments. In other words, the swinging operation of the swinging member about a fulcrum set at a support located closer to either the upper aperture or the lower aperture makes it possible to positively produce an ink flow either from the bottom to the above or from the above to the bottom in the hollow portion of the swinging member. In this case, either the upper aperture or the lower aperture functions as a first aperture located close to one end of the swinging member for introducing liquid and the other functions as a second aperture located close to the other end of the swinging member for making the liquid flow out. The direction of the flow of the liquid can be determined suitably in accordance with a shape of a liquid storage space, a kind of liquid, and the like. What is required is for the liquid flow to occur through, at least, two apertures and a hollow portion created between the apertures. Accordingly, the number, location, shape and the like are selectively determined for the hollow portion and apertures of the swinging member. Also, liquid is fed into a liquid container comprising such a swinging member by use of an infusion needle as in the case of the foregoing embodiments. As a result, it is possible to reduce the amount of bubbles occurring and/or remaining.

The structure of flowing means for producing a flow of the liquid passing through the hollow portion of the swinging member can be selectively determined. As this structure, structure involving the swinging movement of the swinging member as described alone is not specified. For example, the swinging member may be fixed. In this case, instead of moving the swinging member, a flow of the liquid may be induced from the outside of the liquid container, and the flow may be used to produce a difference in pressure, at least between portions of the liquid close to two apertures in the swinging member.

The swinging member is only one of various forms of the stirring member and accordingly the shape and the moving form of the stirring member are not particularly limited. Specifically, other than the stirring member swingable (turnable) about a certain fulcrum, the stirring member may be capable of reciprocating along a predetermined track or of moving freely along a certain face of the liquid container. It is important that a liquid flow is produced in the hollow portion of the stirring member in step with the movement of the stirring member. The liquid is fed into the liquid container comprising such a stirring member by use of the infusion needle as in the case of the foregoing embodiments. As a result, it is possible to reduce the amount of bubbles occurring and/or remaining.

As means for producing a liquid flow in a hollow portion of the stirring member, a centrifugal force and/or an inertial force of the liquid and the like can be used as well as a negative pressure of the liquid generated around an aperture on the basis of Bernoulli theorem when the aperture of the stirring member and the liquid are relatively moved. In other words, it is possible to, for example, utilize a centrifugal force of the liquid in the hollow portion caused by the swinging movement of the stirring member or to utilize an inertial force of the liquid caused inside and outside the hollow portion by moving and stopping of the stirring member. Mechanical kinetic energy, magnetic energy or the like can be externally introduced and used as a drive force to move the stirring member. The liquid is fed into the liquid container comprising such a stirring member by use of the infusion needle as in the case of the foregoing embodiments. As a result, it is possible to reduce the amount of bubbles occurring and/or remaining.

In the foregoing embodiments, the needle-shaped member (infusion needle) in which a liquid flow path is formed is used as the liquid loading member for loading liquid (ink) into the liquid reservoir (ink reservoir). However, what is required is for the liquid loading member to allow liquid to flow through the liquid loading member into the liquid reservoir. The liquid loading member is not necessarily required to be in a needle-shaped form. It is important that a loading flow path is provided for loading liquid into the liquid reservoir. The number of the liquid loading member equipped, and the direction of liquid flowing out from the liquid reservoir and the hollow portion of the stirring member can be determined suitably in accordance with the size, form and the like of the liquid container. The liquid loading member may have an air vent passage formed therein for making the air escape from the liquid reservoir and the hollow portion of the stirring member to the outside when the liquid is loaded, as well as a flow path formed therein for loading the liquid. A liquid loading member for forming a flow path for loading the liquid and a liquid loading member for forming an air vent passage may be employed.

In the foregoing embodiments, as an example of the liquid container in the present invention, the case when it is applied as a cartridge-type ink tank (ink cartridge) which is mountable on a so-called serial scan type ink jet printing apparatus has been described. However, the present invention is not limited to the allocation only to the ink cartridge, and is widely applicable as the liquid container for storing various liquids. The liquid container needs to comprise a swinging member having a hollow portion formed therein for guiding liquid. For the purpose of stirring the liquid in the liquid container, for example, the liquid container can be mounted on a carrier and the carrier can be reciprocated in order to swing the swinging member. The movement of the liquid container is not limited to reciprocating movement. For example, if the liquid container is moved in a certain direction, then stopped once, and then moved again in the same direction to move the swinging member, the liquid can be stirred.

The printing apparatus according to the present invention is applicable to, as well as general printing apparatus, apparatus such as a copier, a facsimile having a communications system and a word processor having a printing unit, and also an industrial printing apparatus compositely combined with various processors.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-119913, filed Apr. 27, 2007, which is hereby incorporated by reference herein its entirety.

The invention claimed is:

1. A liquid loading method for loading liquid into a liquid container constructed to house liquid, wherein a stirring member having a hollow portion formed therein is provided in the liquid container, the method comprising:

inserting a liquid loading member for loading liquid from the outside of the liquid container into the inside of the liquid container; and loading the liquid into the liquid container through the liquid loading member to reach or exceed a level for submerging at least a part of the hollow portion of the stirring member in the liquid, wherein the liquid loaded into the liquid container is ink including a pigment component.

2. A liquid loading method according to claim 1, wherein the liquid loading member is inserted into the liquid container and then located in the hollow portion of the stirring member.

3. A liquid container constructed to house liquid, comprising:

a stirring member having a hollow portion formed therein;

an insertion site which allows a liquid loading member for loading liquid into the liquid container to be inserted from the outside of the liquid container into the inside of the liquid container; and a partition for partitioning the liquid container into a liquid storage chamber for directly containing the liquid and a negative-pressure generating chamber for applying a negative pressure, wherein the insertion site is located to allow the liquid to be loaded into the liquid container through the liquid loading member to reach or exceed a level for submerging at least a part of the hollow portion of the stirring member in the liquid, and wherein the partition defines a communication portion for communicating the liquid storage chamber and the negative pressure generating chamber, and the stirring member is provided in the liquid storage chamber.

4. A head cartridge, comprising:

the liquid container according to claim 3; and a liquid ejection head capable of ejecting the liquid introduced from a liquid delivery port of the liquid container.

5. A liquid container according to claim 3, wherein the liquid loading member is inserted into the liquid container and then located in the hollow portion of the stirring member.

6. A liquid container according to claim 3, wherein a part of an upper aperture of the stirring member is located lower than an air-liquid interface between air and liquid loaded by the liquid loading member.

7. A liquid container according to claim 3, wherein the liquid to be loaded into the liquid container is ink including a pigment component.

* * * * *